US008490216B2

(12) United States Patent
Haynes

(10) Patent No.: US 8,490,216 B2
(45) Date of Patent: Jul. 23, 2013

(54) X-SHAPED UTILITY GARMENT

(76) Inventor: Larry Haynes, San Francisco, CA (US)

( * ) Notice: Subject to any disclaimer, the term of this patent is extended or adjusted under 35 U.S.C. 154(b) by 208 days.

(21) Appl. No.: 12/756,140

(22) Filed: Apr. 7, 2010

(65) Prior Publication Data

US 2010/0313329 A1 Dec. 16, 2010

Related U.S. Application Data

(60) Provisional application No. 61/167,434, filed on Apr. 7, 2009.

(51) Int. Cl.
*A41D 1/04* (2006.01)

(52) U.S. Cl.
USPC ..... 2/102; 2/461; 2/462

(58) Field of Classification Search
USPC ..... 2/102, 460, 461, 462, 463, 93, 94, 2/326; 224/415
See application file for complete search history.

(56) References Cited

U.S. PATENT DOCUMENTS

| | | | | |
|---|---|---|---|---|
| 1,290,827 | A * | 1/1919 | Yergason | 224/623 |
| 3,529,307 | A * | 9/1970 | Belson et al. | 2/94 |
| 4,369,526 | A | 1/1983 | Clutts | |
| 5,024,360 | A * | 6/1991 | Rodriguez | 2/102 |
| 5,211,321 | A | 5/1993 | Rodriguez | |
| 5,247,707 | A | 9/1993 | Parker et al. | |
| 6,260,202 | B1 * | 7/2001 | Villalobos et al. | 2/102 |
| D640,417 | S * | 6/2011 | Haynes | D29/101.4 |
| 2005/0210569 | A1 * | 9/2005 | Panzenbock et al. | 2/463 |
| 2010/0282808 | A1 * | 11/2010 | Debnam et al. | 224/637 |

* cited by examiner

*Primary Examiner* — Alissa Tompkins
(74) *Attorney, Agent, or Firm* — Morrison & Foerster LLP

(57) ABSTRACT

The invention provides a generally X-shaped utility garment comprising two main straps that form an 'X-shape' on a wearer's back and a cross-strap above the X shape to stabilize the garment on the wearer's body. The garment, referred to herein as a strapvest, provides a plurality of pockets and/or receptacles for carrying items the wearer needs to access easily. Its receptacles can be detachable, and a user can select which receptacles to have on the strapvest according to the wearer's immediate needs. It can be adjustable in size to fit a wide range of wearers, and can be adapted to carry many different types of items that are needed for work or recreation, by a combination of built-in pockets and other built-in carriers and optional modular receptacles that can be detachably mounted on the straps of the strapvest. It is more convenient for accessing the stored items than a backpack, which needs to be removed to access its contents; it carriers more and potentially heavier items than a utility belt without a tendency to pull the wearer's pants down; and it can be worn with a variety of different types of weather-related or protective outerwear because of its open design and potentially adjustable size.

13 Claims, 13 Drawing Sheets

X-SHAPED UTILITY GARMENT

RELATED APPLICATIONS

This application claims benefit of priority to U.S. Provisional Application Ser. No. 61/167,434 filed Apr. 7, 2009, the contents of which are incorporated herein by reference in its entirety.

BACKGROUND OF THE INVENTION

This invention relates generally to a wearable garment that functions as a carrier for miscellaneous items, and more particularly to an X-shaped utility vest or utility garment referred to herein as a strapvest.

Various types of workers, including painters, carpenters, electricians and the like, need to carry many small tools and other items with them during the course of their work. For a particular task, they may need to have many different tools close at hand for immediate access, as well as various fasteners and personal items. These needs arise while working at a site far removed from tool boxes or secure storage sites, and it is often very inconvenient or even dangerous to have to step away from the work in progress to search for an item that is needed. For example, a painter may need to carry a caulking gun, a paint scraper, brushes, tape, a hammer or screwdriver, and the like. A carpenter may need to carry a tape measure, hammer, chalk line, pencil, nail sets, chisels, screw drivers, and the like, as well as cutting tools, nails or screws. Many workers also enjoy listening to music or other audio programs while working, in which case they will need to carry a portable mp3 player, CD player or other portable audio device requiring headphones, or they may carry a cell phone that needs to be readily accessible and may include an earphone for privacy or just so they can hear over the noise of the workplace. Recreational enthusiasts experience a very similar need for easy access to diverse items when they may be outdoors for fishing, hiking, or other activities.

A variety of tool holding belts and backpacks are available for workmen and others; however, those often make it difficult to access the tools or difficult to sit or drive while the devices are worn. Additionally, only so many tools can be carried on a belt due to the limited portion that is accessible to the user when it is being worn. Backpacks and fanny packs provide personal storage for items their wearers needs to have travel with them, but provide limited access and organization.

A few specialty vests have been developed, for example, a vest that holds batteries for users of electric equipment, or a vest that holds camera lenses and accessories for a photographer; however these vests cover the entire torso of the user, thereby reducing the amount of ventilation to the torso—they become an item of outerwear that may be unwelcome or inappropriate for the conditions, and are typically designed to close in front in ways that restrict the wearer's ability to sit down, for example, when loaded with items. See U.S. Pat. Nos. 5,211,321; 4,369,526; and 5,247,707. Additionally, these specialty vests have to be made in a variety of sizes because one size does not fit a range of different users well enough for comfort and convenience; indeed, one that fits a user in the summer may not be compatible with changing outerwear for different seasons even for the same user, i.e., it may be unduly warm to wear in warmer weather, and may be difficult to wear over a coat in colder weather. Finally, known vests are generally designed to fulfill one specialized function and cannot be adapted to fulfill multiple functions: their pockets and other features for carrying items are typically 'fixed' in size and location, while a user may have quite different needs at various stages of a project, or for different projects, and it is impractical for one person to buy and store a variety of different specialized garments. There thus remains a need for a highly flexible utility garment that complements or replaces pockets found in typical pants or shirts, and is more convenient to use than a purse, handbag or backpack. The ideal garment would accommodate variations in a user's size and outerwear choices; it would be versatile enough to carry many different items required for a particular trip or project, yet would not be unduly burdensome or hot to wear. It might be suitable to wear while driving with minimal inconvenience, and still provide ready access to the most frequently-used items. The strapvest of the invention addresses needs such as these by providing a flexible, functional utility garment suitable for a wide range of tasks while minimizing interference with the user's movements and choice of clothing.

SUMMARY OF THE INVENTION

One object of the invention is to provide a garment or vest that is versatile enough to be used by workers such as painters, carpenters and the like, as well as by sports enthusiasts, hikers, and other recreational users. The garment can have multiple integral pockets and pouches for the purpose of carrying a variety of items, and/or it can have a variable number of receptacles attached to it in order to provide flexibility with respect to items it is adapted to carry. The garment serves to carry and organize tools and supplies that need to be conveniently accessible to a mobile user, and to provide storage compartments for other items a mobile user needs to have close at hand. The strapvest should be adapted to allow storage of items in a variety of positions around the wearer's person, where the items are placed and held to be conveniently accessible for storage and retrieval by the wearer.

Another object of the invention is to provide a utility garment that can be adapted with a variety of different pockets, pouches, or other attachments, depending on the type of tools or supplies the user needs to have close at hand.

Another object of the invention is to provide a versatile garment providing wearable organized storage of items to which the user needs ready access, and one which can be made in a single size that is adjustable to fit users of various sizes, and which can be adjusted to accommodate the user's chosen outerwear. Such a garment might be worn while sitting or driving, and usable for a variety of different types of work and recreation activities.

A further object of the invention is to provide a garment that is light weight and allows the user maximum movement, while providing greater carrying and organizing capacity than a utility belt, for a user who needs ready access to a variety of different small items while remaining mobile. It can be worn and used in combination with a utility belt, which may provide additional carrying capacity and may be better suited for carrying certain items like a larger cordless drill or larger hammers. The garment of the invention also is compatible with a variety of users, and is adjustable to accommodate outerwear the wearer may need to wear concurrently with the vest, for protection or comfort.

Yet another object of the invention is to provide a garment for carrying many items that is adapted to accommodate a head phone or earphone assembly for an audio device like a cell phone, CD player, mp3 player, or the like, so such devices can be readily accessible to a user.

Still another object of the invention is to provide a garment for carrying many items that provides maximum ventilation to the torso of the user, and which can be worn with other appropriate outerwear the user may need for warmth or protection. Typically, the strapvest will be adjustable enough to be worn over a coat or protective garment according to the wearer's needs, and will be adjustable in size to fit securely either with or without such garments.

Other objects and advantages of the present invention will become apparent from the following descriptions, taken in connection with the accompanying drawings, wherein, by way of illustration and example, various embodiments of the present invention are disclosed.

The drawings constitute a part of this specification and include exemplary embodiments of the invention, which may be combined in various forms as appreciated by a person of ordinary skill. It is to be understood, however, that the drawings depict only certain embodiments and do not limit the invention.

DETAILED DESCRIPTION OF SELECTED EMBODIMENTS

Figure 1:
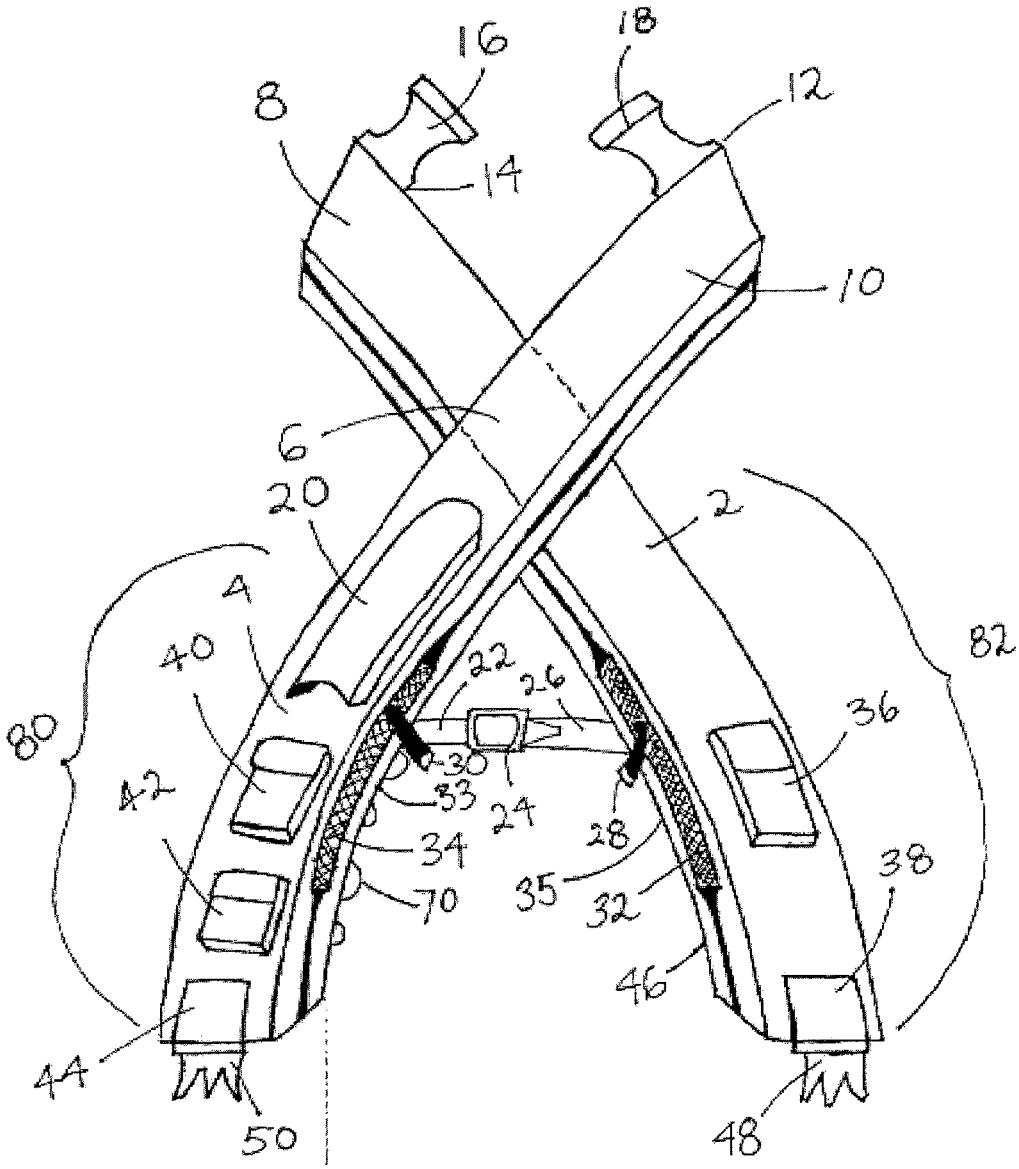
FIG. 1 a plan view of an X shaped strapvest of the present invention.

Detailed descriptions of some of the preferred embodiments are provided herein. It is to be understood, however, that the present invention may be embodied in various forms. Therefore, specific details disclosed herein are not to be interpreted as limiting, but rather as a basis for the claims and as representative examples for teaching one skilled in the art to employ the present invention in virtually any appropriately detailed system, structure or manner.

The invention provides a particularly versatile garment or wearable device adapted for conveniently carrying a variety of small tools and parts, etc., while keeping the wearer's hands free and movements unencumbered. The device is adapted to be worn on the user's torso, with straps running over the wearer's shoulders, and is adapted to accept a variety of removable pockets or receptacles that can be attached or detached, and can be flexibly positioned to adapt to a particular user's carrying needs on a given day. The device has the straps joined across the user's back (note that descriptions of 'front', 'back', up, down, right and left, etc., unless otherwise stated, refer to positions or directions relative to a user's or wearer's perspective, assuming the device is being worn in its intended fashion by a user who is standing up).

Some embodiments of the invention, which is further described below with reference to the Figures provided herein, include:

A wearable strapvest, comprising a juncture having an upper right edge, a lower right edge, an upper left edge and a lower left edge;

a right shoulder strap extending upwards from the upper right edge and having a first buckle portion near its distal end;

a left shoulder strap extending upwards from the upper left edge, having a second buckle portion near its distal end;

a right lower strap extending downwards from the lower right edge, having a third buckle portion compatible with either the first or second buckle portion near its distal end; and a left lower strap, extending downwards from the lower left edge having a fourth buckle portion compatible with either the first or second buckle portions near its distal end;

wherein the right shoulder strap runs upward from the juncture over the shoulder of a user then downward over the torso of the user to permit the first buckle portion to connect with the third or the fourth buckle portion, and the left shoulder strap runs upward from the juncture over the shoulder of a user then downward over the torso of the user to permit the second buckle portion to connect with the third or fourth buckle portion, wherein the right and left lower straps extend downward from the juncture and are contoured to allow the straps to conform to the body of a user when worn with the shoulder and lower straps buckled together as described above;

and wherein the portions of the right and left shoulder straps are adapted to permit receptacles to be detachably attached to portions of the surface of the straps facing outward from the users body on those segments of the shoulder straps that are on the sides and/or front of the user when the strapvest is worn.

In some embodiments of this aspect of the invention, at least one of the two lower straps comprises two layers joined along their lower edges and a zipper near their upper edges to provide access to a pocket formed between the two layers of the strap.

In some embodiments of this aspect of the invention, the juncture is bisected either vertically or horizontally into two parts that are adapted to zip together reversibly or to connect together by a single-point attachment.

In some embodiments of this aspect of the invention, it includes at least one elongated receptacle that has an opening at the top that is sufficiently rigid to remain open when not subject to pressure and is positioned on the strapvest (one of the straps, or on the juncture, or attached to the cross-strap, or attached to the cross-strap and the juncture for example) at a point on the wearer's back to receive an elongated object that can be placed in the receptacle by a wearer reaching over his shoulder. This receptacle is particularly useful for carrying longer items, which can be put into or removed from the receptacle by a user reaching over his shoulder like an archer taking an arrow from a quiver. This receptacle holds elongated items that would be awkward to have in front of the wearer or on his side, yet provides relatively convenient access to them. The opening or mouth of this receptacle faces up and its lower end can be either open or closed, depending upon its use; commonly the lower end is closed and the receptacle length is more than half the length of the item(s) it is intended to contain so that they are securely held. The opening or mouth of this receptacle is preferably held open so the user can easily put items into it, such as by a band of plastic or similar material that is nonetheless typically flexible enough to permit the mouth of the receptacle to lie relatively flat when empty if the wearer's back is in contact with, e.g., the back of a chair or car seat.

In some embodiments of this aspect of the invention, the first buckle portion connects to the third buckle portion, and the second buckle portion connects to the fourth buckle portion. In those embodiments, the straps of the strapvest effectively cross in front of the wearer.

In some embodiments of this aspect of the invention, the first buckle portion connects to the fourth buckle portion, and the second buckle portion connects to the third buckle portion. In those embodiments, the straps of the strapvest effectively run up and down in front of the wearer's body. In such embodiments, the two main straps may be joined together in front of the wearer's body as further described herein.

In some embodiments of this aspect of the invention, the juncture is bisected by a zipper.

In another aspect, the invention provides a strapvest as further described herein, comprising:

a pair of main straps that are attached together to form an X shape across the wearer's back, where each strap is adapted to hold a plurality of removably attachable receptacles on the strap surface away from the wearer's body or to provide a plurality of pockets, loops, or other built-in cargo carriers or compartments, and wherein each of the straps runs upward from the juncture so that one strap passes over the wearer's right shoulder and the other strap passes over the wearer's left shoulder, then each strap runs down the wearer's torso in front of the wearer's body and curves around the wearer's torso at a level below the position of the junction on the wearer's back, and then runs up to the junction to complete the X-shape of the garment. The straps may be contoured to run down one side of the wearer's boy in front, so they do not cross in front of the wearer, or they may be contoured to cross over each other in front of the wearer. This strapvest further comprises a cross strap that connects the two main straps together at a point on the wearer's back above the junction.

In some embodiments of this aspect of the invention, each of the straps includes a buckle that can be disconnected, wherein each buckle is positioned to be accessible to the wearer when the vest is being worn as intended so the wearer can disconnect one or both buckles to remove the vest. Alternatively, the main straps may be continuous, i.e., they may not include a buckle. Such embodiments can be put on or taken off by lifting the strapvest over the wearer's head; or versions wherein the main straps are releasably connected in front rather than crossing over can be removed like a conventional vest, by releasing the connection between the main straps.

Figure 10:
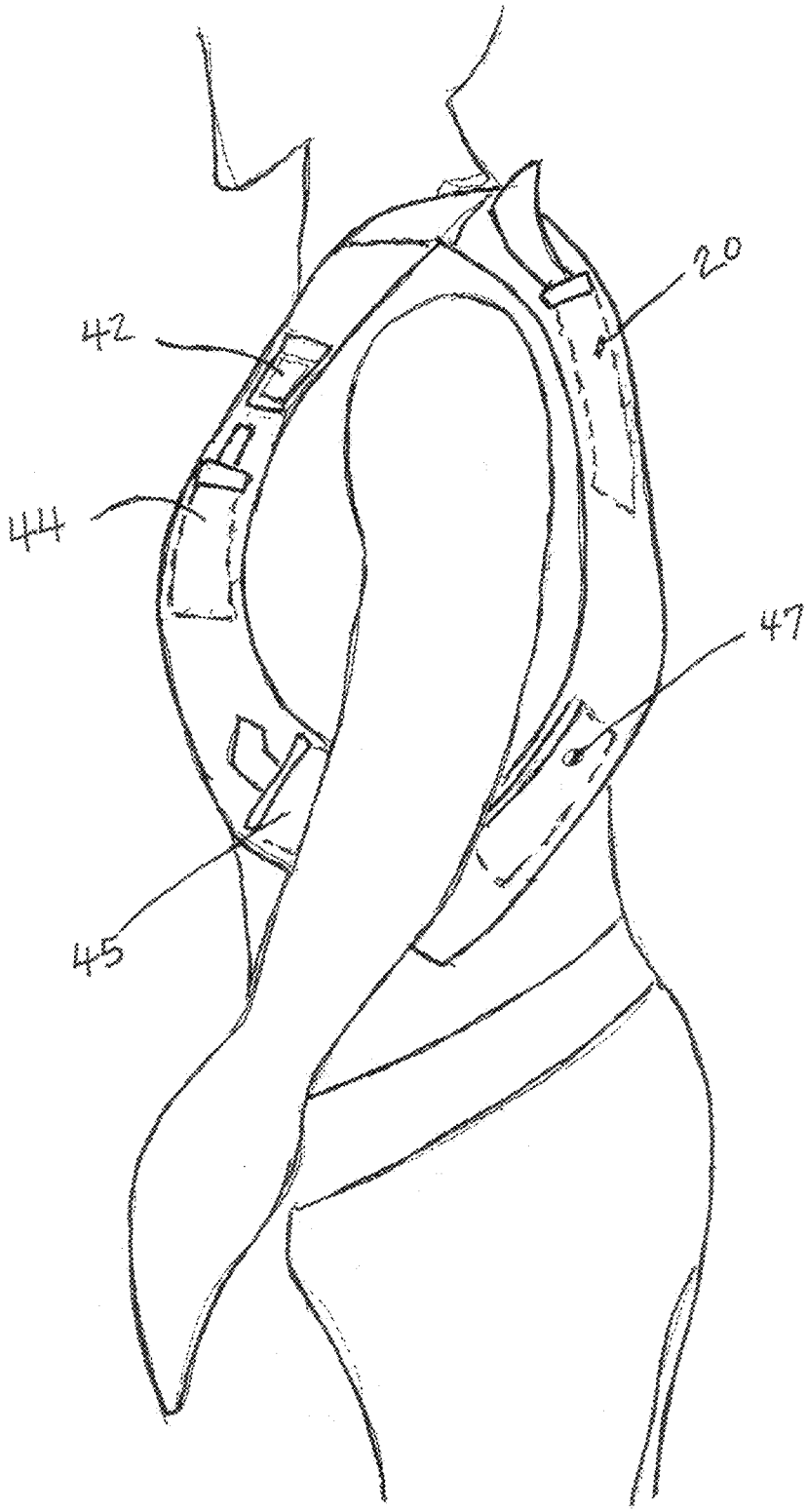
FIG. 10 shows how a strapvest can look from the side when outfitted with pockets on the front and back straps. Straps in the back can have a zipper to hold enclosed items securely so they are available but not necessarily in the most convenient places for access, e.g. identification or a driver's license for example; while straps in the front may have pockets inside the straps, and would be used to hold items that are more frequently accessed by the wearer.

In some embodiments of this aspect of the invention, each strap has a first layer and a second layer along at least a portion of its length, and the first layer and second layer are connected along at least one edge and optionally along both edges to form a compartment between the two layers. In some embodiments, the first and second layers are further connected together across the width of the straps (e.g., the strap layers can be sewn together transverse to the main length of the strap) to form a first end and a second end of the compartment, and a zippered opening along the length of the strap between the first end and second end of the compartment can be included to provide access to the interior of the compartment. In other embodiments, the first and second layers are connected together transverse to the strap's length to form one end of a compartment, and an opening is provided in the outer layer of the two-layer strap to insert items into the compartment. The opening is typically at the end of the compartment that is positioned higher up when the strapvest is worn, so items placed in the compartment (a built-in pocket) tend to stay there. Optionally, the straps can also be connected together (by, e.g., being sewn together) just past (above) where the opening is provided. The various types of compartments disposed on the straps can be positioned on parts of the straps that are in front of the wearer's body, or on portions that fall on the wearer's sides or back that are accessible to the wearer's hands when the strapvest is being worn. FIG. 10 illustrates placements of compartments 20 and 47 that would be accessible to the wearer by a wearer reaching around the side or over the shoulder.

In some embodiments of this aspect of the invention, the strapvest has one or more cord holders on at least one of said straps positioned near the shoulder of a wearer. These cord holders are adapted to retain a wire for a headphone or earphone or microphone of an audio device and bring it conveniently close to the wearer's ear or mouth (voice) while keeping it constrained so it does not get in the way of the active wearer.

In some embodiments of this aspect of the invention, the cross strap is adjustable in length.

In some embodiments of this aspect of the invention, each main strap has an inwardly facing curve at its lower end (i.e., in the section that wraps around the wearer's body) to aid in the tailored fit of said vest straps with regard to a person's torso.

In some embodiments of this aspect of the invention, the portions of the straps that run down the front of the wearer's body cross over each other in front of the wearer's body before they run around the wearer's torso at a level below the level of the junction, and curve upward if necessary to rejoin to the junction.

In some embodiments of this aspect of the invention, the portions of the straps that are in front of the wearer's body are connected to each other in front of the wearer's body. In such embodiments, the straps may not cross in front of the wearer's body, so the strapvest can be put on or taken off by sliding it backwards off the wearer's shoulders like a conventional vest.

In some embodiments of this aspect of the invention, the portions of the straps that are connected to each other in front of the wearer's body are connected by a zipper, button, post, buckle, hook and loop fastener, or strap, or by other conventional releasable closures. A buckle, button, post, hook and loop or other releasable closure typically comprises two mated parts; those parts can be placed directly on the main straps, or one or both of the mated parts of the releasable closure can be put on a securing strap that is connected to the main strap. This securing strap can optionally include a length adjustment, such as a slider device or a cam-type buckle.

In some embodiments of this aspect of the invention, wherein the portions of the straps that are connected to each other in front of the wearer's body are connected by a single point closure such as a button or snap.

In some embodiments of this aspect of the invention, at least one pocket or removably attachable receptacle is positioned on a strap portion on the wearer's back. Typically, such pocket is positioned high on the wearer's back so items can be placed there or accessed by a wearer reaching over on shoulder: a portion of an item in such a pocket will extend up and be reachable by a wearer reaching over the shoulder near the wearer's ear. Alternatively or in addition, a pocket or compartment on one of the main straps positioned on the wearer's back may be on a part of one of the main straps below the juncture, and typically would be a relatively flat compartment for comfort reasons. For this compartment (see, e.g., compartment 47 on FIG. 10), convenient access might be provided by a zippered opening on the higher side or end of an integral pocket built into one of the main straps.

In yet another aspect, the invention provides a strapvest as further described herein, comprising two main straps which meet at a juncture, where the juncture is positioned on a wearer's back and the main straps run upward from the juncture so that one main strap goes over each of the wearer's shoulders; and a cross strap above the juncture and running across a portion of the wearer's back, where the cross strap connects the main straps together;

wherein each main strap runs from the juncture up over the wearer's shoulder, down a portion of the wearer's torso, and around one side of the wearer's body to reconnect to the juncture at a lower portion of the juncture; and wherein each main strap comprises two or more pockets or is adapted to mount two or more detachable receptacles. The main straps may be continuous, or one or both of them may be interrupted by a releasable connection such as a buckle.

In some embodiments of this aspect of the invention, the two main straps are permanently connected to each other in front of the wearer's body. In other embodiments, they are configured to be releasably connectable, as by a button, zipper, strap, buckle, hook and loop closure and the like.

In some embodiments of this aspect of the invention, the two main straps are connected in front of the wearer by a single-point closure.

In some embodiments of this aspect of the invention, the single-point closure comprises a button, snap or stud-type closure on one main strap and a complementary (mating) connecting feature on the other main strap; and the single point closure is positioned to be placed over the lower sternum of the wearer or just below the sternum of the wearer.

In any of the above aspects and embodiments, the strapvest can comprise a plurality of receptacles adapted to detachably connect to the strapvest by means of the attachment structures on the strapvest. The receptacles may be attached to the strapvest, or they may be packaged with the strapvest for distribution to a user. Preferably, the strapvest and a plurality of receptacles of varying sizes are packaged together so a user or buyer can select a suitable number of receptacles of suitable size for the particular needs of the day. Alternatively, the carrying capacity of the strapvest may be comprised partly or exclusively of compartments integral to the strapvest, such as pockets built into the straps or sewn onto the straps, and/or loops or bands of material permanently attached to the vest, and the like. Pockets integral to the straps may be made by adding a layer of material onto a portion of a strap, or they may be built into a strap as between two layers of strap material as further described herein. Pockets may be open on one edge, and may also have a closure such as a zipper or a flap that can be buttoned or held in place by e.g. a hook and loop material like Velcro™ to retain contents in the pockets. Loops or bands attached to the straps for holding items may be elastic bands that provide pressure and friction to hold an item in place, or they may comprise a loop of material extending outward from the surface of a main strap like loops on a typical utility belt, designed to hold a hammer (for example) that can swing loose without falling out. These bands or loops are typically sized according to the item to be carried.

The invention provides an X-shaped vest having two main strap-like portions that meet at a juncture that would be located on the back of a wearer when in use. The main straps can be made of materials commonly used for a utility belt or similar products, such as nylon, polypropylene, polyester, or cotton material, which can be a woven fabric such as webbing; a heavy fabric such as canvas, a breathable fabric such as GoreTex®, or a flexible non-woven material such as leather or microfiber. The main straps can be single-layer straps of this material, or two layers of material can be attached together. Optionally, the main straps can be made of a layer of material such as nylon webbing that runs the full length of each strap and a second layer that is present only on selected portions of the strap: for example, a strap might be made of polypropylene webbing and have a backing layer in sections that can be present on sections where it could be used to form pockets on the inner surface of the strap (toward the wearer's body), or it can be used to provide a smoother inner layer of material where it runs over the wearer's shoulders for comfort. Typically the straps are between about 2" and 6" in width, but the straps are not necessarily of a consistent width along their length, so the width may vary to meet the needs of a particular design.

When two layers are used to form a strap, there is an inner layer that faces the wearer's body when the strapvest is being worn and an outer layer facing away from the wearer's body. The two strap layers may be made of the same material or different materials. For example, the outer layer could be nylon webbing for strength, and the inner layer could be leather, cotton or other fabric, or microfiber for increased comfort or to reduce the wear on the wearer's clothing where the strapvest comes in contact with the wearer's clothing or body. As further described below, where two layers are used, the layers are commonly attached together along their edges, creating an interior space. This interior space can be used to form pockets integral with the strapvest straps, and these pockets can be open or closed at their upper and lower ends as further described below. Alternatively, the straps can be formed of a tubular material, which may have a seam or not; where a seam is present, it may be positioned to face the wearer's body or it may face away from the wearer's body, on the outer surface; or it may be positioned as an edge of the strap. It is also sometimes desirable for the two main straps to be made of different materials, and of course the selection of colors and aesthetic patterns can be made in accordance with the planned use of the strapvest.

Each main strap portion can include a buckle that allows the main strap-like portions that form a loop when worn to be opened or allows the strapvest to be removed, and each said strap portion optionally has a plurality of removably-attachable pockets or sleeves (receptacles) adhered or connected to the outside surface. Portions of the main straps can be formed from two layers and can have a zipper connecting the layers in places to form accessible pockets inside the strap, so a person can store flat items in a pocket formed by the layers and accessible/closable by use of the zipper. One or more of the straps can have hooks or loops capable of retaining a wire or cable, such as a wire to a headphone or earphone for portable audio devices.

The garment also can have an optionally adjustable cross strap that connects the two straps together to maintain the X-shape of the garment; this cross strap would be positioned on the back of the wearer, above the juncture, and is sized to keep the straps from slipping off of the wearer's shoulders when in use, and positioned to keep the strapvest from slipping forward under a load that is often disproportionately positioned on the front of the wearer's body for convenient access. The strap portions are contoured to conform to the body of a user so that they generally lie reasonably flat and comfortable when the garment is worn.

Each main strap portion can include a buckle that allows the main strap-like portions that form a loop when worn to be opened or allows the strapvest to be removed, and each said strap portion optionally has a plurality of removably-attachable pockets or sleeves (receptacles) adhered or connected to the outside surface. The receptacles can be made of the same material as the straps or of different materials; commonly they are made of plastic material that is flexible enough to conform to the contours of the strapvest when it is worn. In some embodiments, the strapvest includes hook-and-loop material in patches or strips along its length or across its width, to serves as attachment points for the receptacles, which can have complementary hook-and-loop material in order to fasten them to the material on the straps. The Figures illustrate suitable placements and sizes for these patches or strips; typically, a plurality of such patches or strips are provided on each of the main straps along a majority of the length of the portions that are accessible to the users hands when the strapvest is being worn.

The receptacles can be relatively flat pockets, or they can be expandable to accommodate items that are up to 0.5" thick, or even up to 3" or more in thickness. Such pockets having collapsible sides to lie flat but having sufficient sidewall material to expand for holding thicker items are well known in the art. In some embodiments, the receptacles are pocket-like containers that have a width (the dimension of the receptacle that will align with the width of the main straps up to about the same width as the main straps, and having a length (defined as the dimension corresponding to the length of the straps) between about 1" and 6", or even up to about 8". Typically the receptacles are substantially rectangular in shape, but they can be of any shape that is suitable for their intended purpose, e.g., a receptacle specifically sized and shaped to hold an MP3 player or cell phone can be provided. Selection of the size and shape for the modular receptacles that can be used with the versatile strapvest design is within the skill of an artisan familiar with the user's needs.

Optionally, receptacles can have a clear plastic portion on their outer surface (a side away from the portion of the receptacle that is adapted to attach to the straps of the strapvest) or a portion covered by an open material like fishnet that permits the wearer to see the contents of the receptacle without opening it. Commonly the receptacles are made of a nylon, polyester, polypropylene, cotton, or similar fabric or blend of these fabrics, for example a 200 or 300 or 400 or 600 or 1000 denier nylon fabric can be used. The material for the receptacles, and for the straps, can be treated to provide waterproofing or to resist staining if desired; methods for such treatments are known in the art. Optionally the receptacles can be made of a waterproof material or lined with a waterproof material to keep their contents dry, such as a non-porous fabric or a breathable fabric like woven polytetrafluorethylene or GoreTex® with pores too small to admit water in liquid form.

In some embodiments, the receptacles are open for quick access; in some embodiments, the receptacles have a flap with, e.g., a snap or button closure; and in some embodiments, the receptacles have a zipper or a Ziploc™-style closure. A strapvest can be used with a combination of such receptacles, each of which has a structure for fastening the receptacle to the vest, such as at least one patch or strip of complementary hook-and-loop material adapted to fasten the receptacle to a corresponding attachment structure on the main straps. Thus in some embodiments, the strapvest is packaged with a plurality of these receptacles, such as a selection of receptacles of varying sizes.

The various embodiments described herein may comprise buckles in the main straps, cross straps, or securing straps. The buckles can be made of metal, like a common belt buckle, or of plastic like the buckles commonly used on backpacks; typically the buckles are configured to permit the length of the straps to be effectively varied by sliding the buckle along the relevant strap, or by adjusting the length of a typically narrower secondary strap carrying the buckle with a conventional slider, where the secondary strap is in turn attached to the main strap. The selection of materials and designs for these buckles is routine in the art.

Portions of the main straps can be formed from two layers and can optionally have a zipper connecting the layers in places to form accessible pockets inside the strap, so a person can store flat items in a pocket formed by the layers and accessible/closable by use of the zipper. One or more of the straps can have hooks or loops capable of retaining a wire or cable, such as a wire to a headphone, microphone, or earphone for portable audio devices. The garment also can have an optionally adjustable cross strap that connects the two straps together to maintain the X-shape of the garment; this cross strap would be positioned on the back of the wearer, above the juncture, and is sized to help keep the straps from slipping off of the wearer's shoulders when in use. The strap portions are contoured to conform to the body of a user so that they generally lie reasonably flat and comfortable when the garment is worn.

In some embodiments, the garment has a fastener that connects portions of the two main straps in the front of the wearer's body; the fastener may connect the two straps so that they can be connected or separated when putting the garment on or taking it off. In some embodiments, the straps connect to each other by a zipper or button(s) or hook-and-loop fastener or snaps or similar closure mechanisms in front of the user's body to facilitate removal or secure the garment on the user's body. In some embodiments, a single attachment via a button, snap, hook, or the like, is provided near the wearer's chest to allow the garment to be readily secured in place, but also allowing it to flex or pivot about the this single point attachment so it adapts to the wearer's body as the wearer sits down or bends over, for example. In some embodiments, a combination of such fasteners can be used.

The device is described as 'X-shaped' due to the general appearance of the device when viewed from behind the wearer: the straps intersect each other at a juncture near the center of the wearer's back when in use. The main straps may cross over each other on the wearer's back to form this juncture, or they may connect to a separate juncture on the wearer's back, which may be made of the same material as the straps or of different material; either way, the general appearance is of an X-shaped device, as the upper parts of the main straps run from the juncture up over the wearer's shoulders and the lower straps go downward from the juncture and around the wearer's torso or waist, forming an X shape on the wearer's back.

The device can be configured to be flexible enough to adjust to fit most adults, so that a single size fits most typical users. Alternatively, it may be of a fixed size. It comprises a pair of main straps that are optionally divided into sections, and intersect at a juncture, or connect by joining to a juncture, which is on the wearer's back. The juncture can be formed by the intersection or overlap of the main straps, or it can be a separate piece of material that can be the same as the strap materials or different. The main straps can be adjustable in length so a user can adjust the effective size of the vest as desired. Suitable methods for making the strap lengths adjustable are known in the art, and include, for example, belt-type adjustments where one strap portion has a series of holes and the second strap portion has a buckle or similar fitting to connect to insert into the holes in the first strap portion. Similarly, sliding adjustments such as the slider devices and buckles as commonly used on shoulder straps for a backpack can be used. Alternatively, conventional cam-type buckles that compress onto a strap can be used to adjust the effective length of one or both main straps to resize the strapvest or to adjust the effective lengths of or as releasable closures for cross, secondary or securing straps described herein. Hook and loop connectors can also be used to allow strap length to adjust.

The juncture can be positioned on the back of a wearer when in use. It can take various shapes, but can generally be considered diamond-shaped, with the straps extending from the upper right edge, upper left edge, lower right edge and lower left edge of the juncture. The juncture can be longer along its edges than the width of the straps, but typically each edge is as at least as wide as the straps are where they attach to it. The straps can be integral with the material of the juncture, or they can be attached to it by any convenient method, such as with adhesives, stitching, rivets, or the straps can run through an opening in or on the juncture and at least one of the straps would then be fastened to the juncture, or to a strap portion attached to the juncture, or to itself in a way that holds it securely to the juncture. In some embodiments, one or both of the main straps can be slidably fitted onto straps attached to the juncture or slots in the juncture, and may optionally have a catch, buckle, clasp, or other mechanism to hold the juncture at a desired position on the strap(s).

In some embodiments, the juncture is bisected by a closure device so that the juncture can be separated into two pieces. The juncture can be bisected by this closure device vertically or horizontally relative to the wearer in a standing orientation. The closure device can be a zipper, one or more buttons or snaps, or a hook-and-loop fastening In some embodiments, the juncture is bisected vertically and has a zipper that connects the two portions of the juncture, where the right portion has the upper and lower right strap portions extending from it and the left portion of the juncture has the upper and lower left strap portions extending from it. The juncture can thus be separated by unzipping this zipper, or it can be assembled by zipping its right and left portions together. This permits the strapvest to be opened and removed from a wearer by unzipping the zipper, or the juncture can be zipped apart to make it easier to clean, adapt, or store the device. The wearer can thus remove the strapvest by an alternative method, rather than by disconnecting any buckles holding the strap portions together. Additionally, a vertically oriented closure device in combination with a releasable closure in front of the wearer allows the strapvest to be separated into two separate shoulder-wearable utility carrying devices.

Note that the term 'upper portion' when referring to one of the main straps are used to refer to the portion of a main strap running upward from the juncture over a wearer's shoulder and down to the point where the two main straps intersect or are releasably connected in front of the wearer. The term 'lower portion' refers to a main strap section extending downward from the juncture around the wearer's toso, and up to the point where the two main straps are connected or intersect in front of the wearer.

In some embodiments where the juncture is bisected by a zipper or similar separable closure device (e.g., hook-and-loop fastening material such as Velcro™ or snaps could be used instead of a zipper), the straps may not need to have buckles to permit disconnection; the straps may be continuous.

Alternatively, the juncture can be separable into upper and lower portions, where the upper portion attaches to the right and left upper strap sections, and the lower portion attaches to the right and left lower strap sections. Again, the user can remove the strapvest by unzipping the zipper to separate the juncture into two pieces. This permits removal of the strapvest without unbuckling the buckles that connect the strap portions, and permits the buckles to be omitted.

The upper straps run upwards and outwards from the juncture to go over the wearer's shoulders, and the lower straps run downward and outward from the juncture to curve around the torso of the wearer. The straps, once in front of the wearer, may or may not cross over each other in front of the wearer, and they may or may not be connected in front of the wearer's body. In many embodiments, the main straps do not cross over each other in front of the wearer. Instead, one remains on the 'right side' of the wearer's body and the other remains on the left side of the wearer's body. Optionally, the vest can include a releasable closure component permitting the wearer to connect the two main straps together in front, which holds the vest more securely on the wearer's body yet permits easier removal than does the closure device in the juncture on the wearer's back. In such embodiments, the wearer can slip the strapvest on or off over the shoulder, like a vest; and it can be hung on a standard clothes hanger when not in use.

The upper and lower straps on each side of the body typically come together, and these straps may be continuous straps or they may be interrupted by a connection that allows them to be adjusted in length. Suitable connections for this purpose include the types of buckles used on a belt, the types of buckles used on the straps for a backpack; a zipper transverse to the length of the strap; or a hook-and-loop section that adheres an upper strap to its corresponding lower strap. Adjustable connections for these straps are often preferred, to provide readily accessible means for adjusting the device to fit a particular wearer or to adjust to accommodate a wearer's changing attire.

Where the straps run up-and-down in front of the wearer's body, the two main straps may optionally be connected to each other. In some embodiments, the straps are joined to each other along their edges (the edges nearest the centerline of the front of the wearer's body) on a portion of the straps in front of the wearer, e.g., for a distance up to about 12 inches and preferably less than 10 inches, and frequently less than about 6 inches, the edges of the two main straps may be zipped together or overlap enough to permit them to be attached to each other by one or more connector straps that can buckle together, snaps, buttons, hook and loop closures, or other conventional fasteners. This joining of the right strap and left strap portions better secures the device around the wearer's body; but limiting the length of the connection makes the device more flexible and more comfortable. Optionally, the straps may be joined in front by one or more snaps or buttons or similar types of connectors instead of a zipper. Other closure methods such as a hook-and-loop closure, or a connecting strap (securing strap) joining the two main strap portions together can also be used.

In a preferred embodiment, the right and left portions of the main straps are joined together by a single button, snap, or stud/hole in front of the wearer's body, to provide a pivoting single-point closure connecting the straps. This pivoting closure holds the device securely in place, but permits the two main straps to pivot about the closure, which provides an advantage by preventing the device from interfering when the wearer sits down or bends over. Because the straps are often relatively rigid in comparison to a strip of cloth, for example, they can cause inconvenience by sliding around, or lifting away from the body, when the wearer stands up, sits down, or reaches out. With the single point closure, when the wearer sits down, for example, the lower parts of the right and left straps in front of the body swing outward to accommodate the wearer's legs and permit the portions on the wearer's sides to spread out on a seat, for example. The ability to pivot about a single-point closure lets the right and left strap portions swing outward to accommodate the wearer's legs and seating surfaces when the wearer sits or bends forward, so that even if there are relatively rigid items held in or on the straps, the items and straps can remain secure and near the wearer's body without interfering too much with movement.

Figure 2:
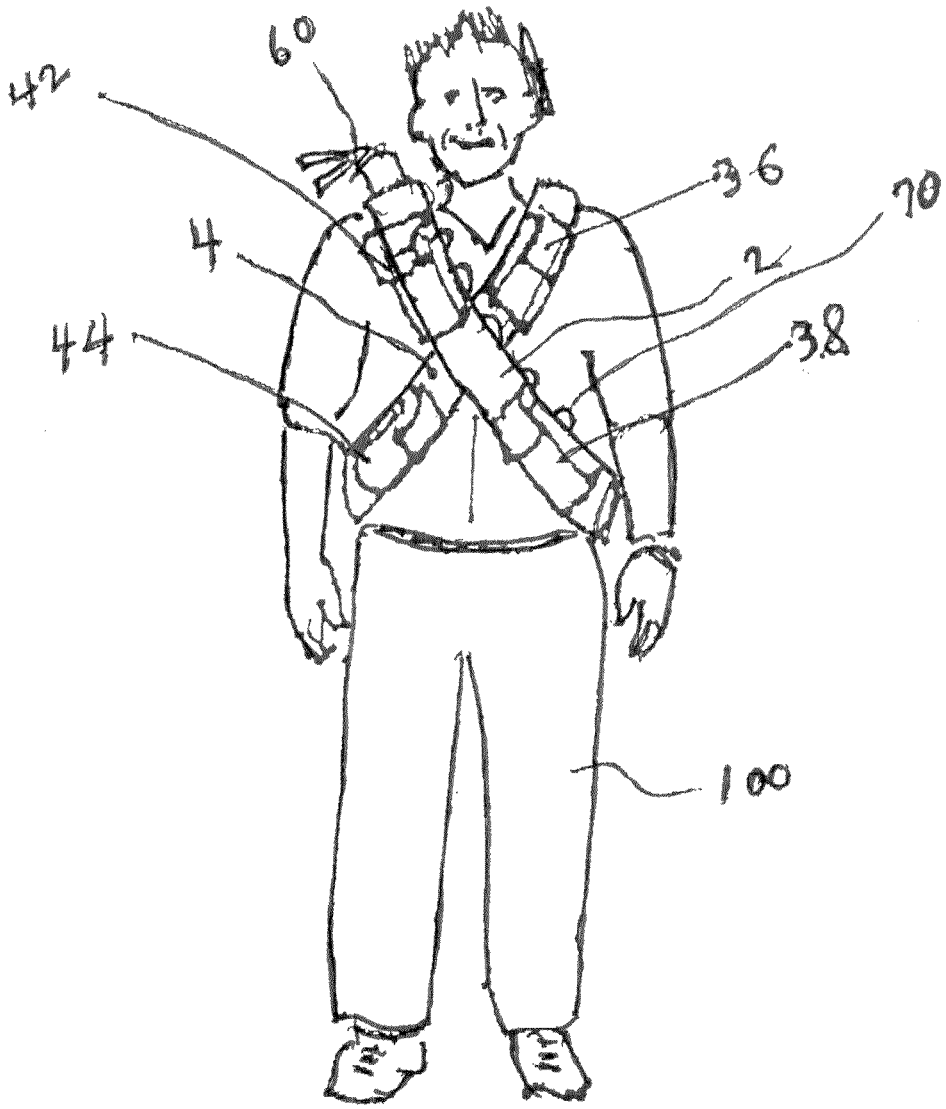
FIG. 2 is a front view of a person wearing an X shaped strapvest of the present invention.

Referring now to FIG. 1 we see a plan view of an X-shaped strapvest of the present invention. The item is made up generally of two main straps, which can be made of a woven material such as nylon web material or other fabric material, by way of example only, that for purposes of clarity are identified by upper sections 2 and 4, and lower sections 8 and 10, which are connected to each other at juncture 6. The upper sections 2 and 4 can be referred to as shoulder straps, because when worn they run upwards from the juncture 6, which is positioned on the back of the wearer, then over the shoulders of the wearer. The juncture is positioned on the back of the user when in use, and the shoulder straps run upward from the juncture, over the shoulders of the wearer and then down the front of the wearer's body. Because the straps in FIG. 1 are contoured to curve inward (toward each other) in front of the wearer, this particular embodiment would have the main straps crossing over in front of the wearer's body as illustrated in FIG. 2.

The two main straps can be sewn together at juncture 6, or otherwise permanently connected such as by rivets or by being interwoven, or they can be attached in a detachable manner such as with a button, snaps, or hook-and-loop type fasteners, or for example, one strap can pass through a loop on the other strap, or between two layers used to make the other strap. The juncture 6 can be simply an overlapping portion of two main straps that cross each other, or it can be a portion of material either separate from or integral with the straps. The juncture can be made of the same material as the straps or of different material, such as leather or plastic or woven nylon like a backpack material. The two straps do not have to be immobilized together at the junction; they can be connected with a button, snap or stud/hole to permit the straps to pivot where they overlap to form a juncture; but in many embodiments, the two straps are immovably connected to each other or to a juncture.

Above the juncture when in use, there is a cross strap that connects the two upper (shoulder) straps to each other. The cross strap can be of a fixed length, or it can be adjustable in length. In FIG. 1, the cross strap (22) is comprised of two separate parts joined together by a buckle (24) so the length of the cross strap can be adjusted as needed. It keeps the device from sliding up or forward too far, such as when the wearer bends forward, by contacting the back of the wearer's neck. It also keeps the shoulder straps from sliding outward and off the shoulders of the wearer. Preferably, the strap is adjustable in length, or the way it attaches to one or both of the main straps can be adjusted to effectively adjust the length of the strap that is between the two main straps. It can be attached to the main straps by any suitable method, such as sewing it to the main straps or by buttons or snaps; and its length can be adjusted like a belt, using a buckle; or by typical sliding connectors that are used either alone or in combination with a buckle.

One or both of the two main straps that form the strapvest are optionally interrupted by a buckle that permits the strap to be separated into upper portions called shoulder straps, and lower portions called lower straps Commonly where buckles are used, each of the main straps will have one to facilitate adjusting the overall size of the strapvest. The upper and lower portions on one side can be buckled together at a point on the side or front of the wearer's body, often near the waist of the wearer. In some embodiments, the main straps cross over each other in front of the wearer (across the wearer's chest, for example). In those embodiments, the right shoulder strap (upper right strap) connects to the left lower strap, and the left shoulder strap connects to the lower right strap. In other embodiments, the main straps do not cross over in front of the user, so the right shoulder strap connects to the lower right strap, and the left shoulder strap connects to the lower left strap.

Strap sections 8 and 10 are attached to buckle portions 16 and 18 that are designed to mate with buckle portions 48 and 50; and these buckle portions can optionally be connected to the shoulder or lower straps by attached adjustment straps 44 and 46 that are in turn sewn or securely fastened to the end of the shoulder straps 2 and 4. The adjustment straps permit the effective length of the main straps to be adjusted to fit most any user; these are similar to the adjustable straps on a backpack or similar device employing conventional adjustable-length straps.

The shoulder straps are also connected to each other by an additional cross strap (22) as discussed above. In FIG. 1 this is provided by two connected adjustable strap segments connected by a cinch buckle 24 that the user can adjust in order to match the vest to the user's torso size.

Figure 13:
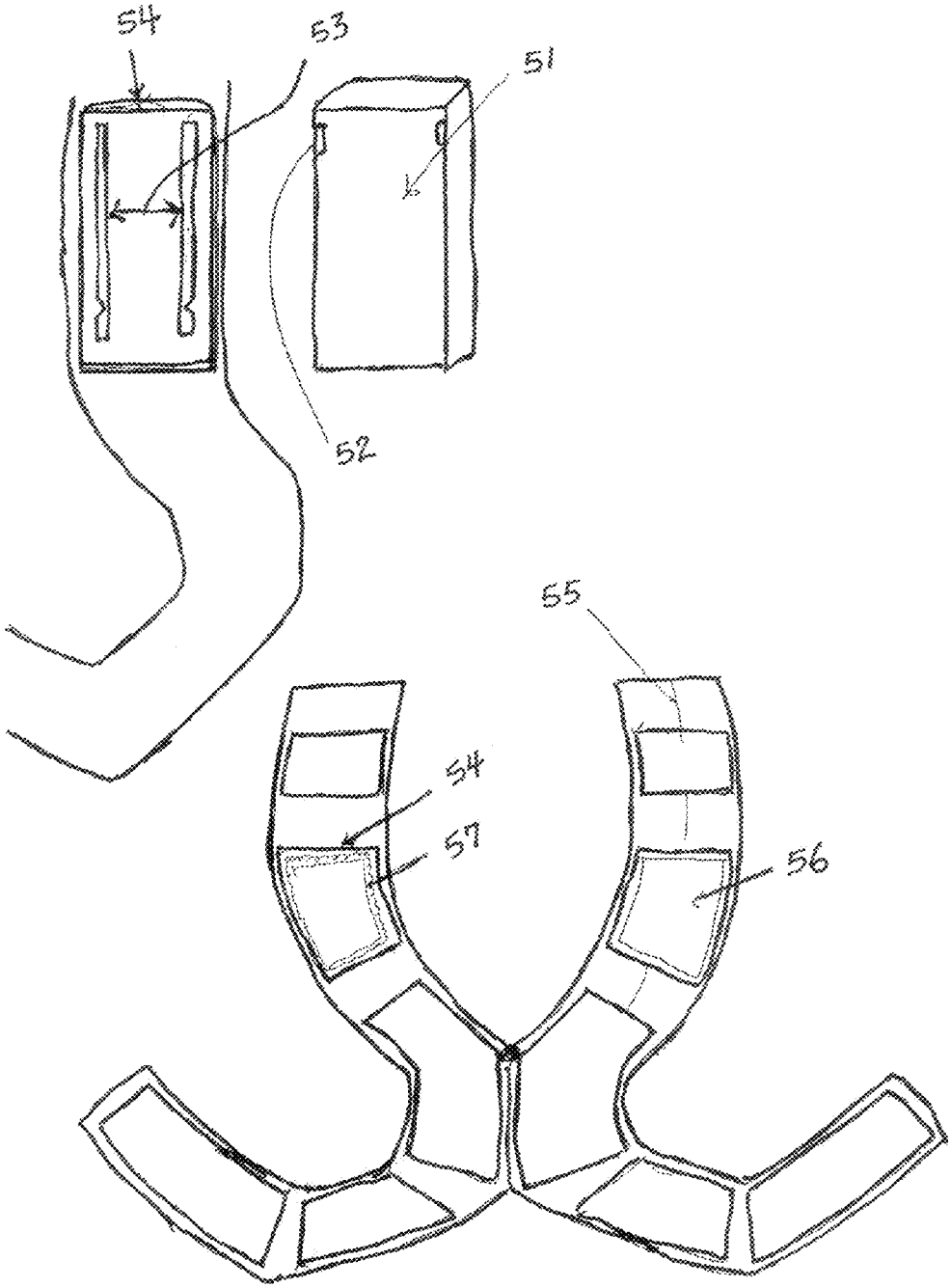
FIG. 13 shows a plastic case that can be used as a detachable receptacle on the vest of the invention, and shows how a base for this case can be placed on a strap of the vest while providing a pocket behind the base. It illustrates placement of tracks to hold the plastic case securely, and a spring-operated mechanism to secure the case to the tracks along with a release button or similar operable mechanism to release the case from the tracks. This Figure also illustrates how a pocket on a strap of the vest can have an additional receptacle attached to the pocket, using a hook-and-loop fastening material attached over the pocket to provide an additional detachable pocket.

Pockets, pouches, or other containers referred to herein as receptacles selected by a user, features 20, 36, 38, 40, and 42, can be removably attached to the main straps by snaps, or hook and loop fasteners, or zippers, or the like. These receptacles can be readily replaced, added or removed, so the strapvest of the present invention can be customized to accommodate tools or equipment needed by the user. The receptacles can be designed to hold whatever item(s) a wearer may want to carry on the strapvest. For example, 20 is an elongated receptacle that can be positioned on a portion of a shoulder strap that lies on the wearer's back, above the juncture. This can be used to hold longer items such as, for example, a caulking gun, and is accessed by the user by reaching over his/her shoulder, like taking an arrow from an archer's quiver. See FIG. 2, showing part of a caulking gun sticking up from this type of receptacle placed on the wearer's back. Other elongated tools like a folding saw, long screwdriver or pipe wrench, or spare hammer might be carried in such a receptacle. Most other receptacles are placed on the straps so that they are positioned on the user's front for easy access, and may be designed as closable pouches for holding, e.g., small fasteners or similar parts, or they may provide a loop that can be opened or closed (e.g., a loop can run through the center of a roll of tape and hold the tape by a hook and loop fastener or a snap). Alternatively, a base can be provided on a portion of a main strap so that the base can provide a mounting platform for a receptacle, such as a small box sized to fit conveniently on the strap when the device is being worn, and positioned preferably along the side or in front of the wearer's body for easy access. For example, the base may be configured so that this receptacle can snap into place on the base. This receptacle can be, for example, a plastic box with a conventionally operable lid having a clasp to hold its lid closed. An example of such a compartment is illustrated in FIG. 13. In one embodiment, the box has fittings to hold it in rails or similar fittings in the base, and optionally the box or base also has one or more clips or similar mechanisms to hold the box on the base securely, and one or more release buttons to enable the user to detach the box from the base. The design and selection of the mechanism for attaching the box to the base on the strapvest are conventional in the art. In addition, pockets and pouches can be built into the straps of the device as further discussed herein.

Optionally, the strapvest can be packaged for sale with a variety of these receptacles, which variety may include more receptacles than the strapvest can accommodate at any one time; thus a user may be provided with a variety of receptacles suitable for tasks or tools specific to a particular day or project, and can customize the strapvest accordingly. Extra receptacles can thus serve as temporary storage for expendable items or small specialty tools. A painter may choose receptacles for paint scraping tools, paint lid openers, masking tape and a caulking gun for the morning; then replace these with receptacles suitable for a screwdriver, sandpaper, and sanding blocks for the afternoon. A carpenter may choose to have receptacles suitable for a chalk line, tape measure, marking pencil, cutting tools, and small fasteners; and for recreational use, the carpenter may modify the receptacles to provide means to carry maps, compass, water bottles, a GPS unit and a cell phone for hiking, by simply removing the receptacles selected for work and substituting for them receptacles suitable for recreational activities. When the user's needs change from day to day or task to task, the user can simply remove a pouch of roofing nails, for example, and replace it with a pouch of drywall screws or finishing nails selected to fit the next project. If the user would like to listen to music or other audio entertainment, or to operate a hands-free cell phone, he or she may choose a pocket that is large enough to hold a CD player, radio, tape player or the like, and the strapvest can include hooks, loops or channels designed to retain earphone cords routed from a pocket or receptacle holding the phone or mp3 player, etc. to a point conveniently near the wearer's ear, to minimize the amount of loose wiring. The user may have a personal cell phone in an inner pocket or receptacle, and a work-related cell phone set up for hands-free operation, and the strapvest can accommodate those items along with tools and the like to allow the wearer to have easy access to each item he needs.

Similarly, an outdoors person can wear and use a strapvest of the present invention for whatever purposes he or she sees fit, too. Receptacles can be sized to hold items like drink bottles, snacks, sunscreen, a hat, and the like, and even a windbreaker designed to fit into a small pouch, enabling a person to use the strapvest for hiking and other outdoor activities, without the wearer overheating while exerting himself. Loops 70 or similar retaining structures located on main strap 4 can retain a headphone cable for music or cell phone devices, so that the cable does not interfere with the user's movements while hiking or fishing, for example, and the available receptacles can be employed to carry snacks, sun screen, a compass or GPS device, a knife or folding saw, or whatever other paraphernalia the wearer needs to have readily available.

A second layer underneath a top layer of one or both of the main strap sections (33, 35) can be attached to the main strap section along one edge to form a bilayer section that forms a flat pocket space inside, which is accessible by a slot or zippered opening on or near the other (open) edge of the bilayer strap portion. Zippers 28, 30 can be unzipped to allow a user to insert flat items into the slots in these pocket-containing sections of the straps (32, 34), and zipped closed to protect the items inside. Optionally, these pockets in the straps may be lined with a plastic or similar water-proof material to protect contents such as cash, credit cards, ID cards, etc., in the event that water, paint, or other liquid contacts the outside of the strap in these sections.

Pockets or receptacles used with the strapvest or built into it can be open, or they can have a variety of different types of operable closures. A pocket or pouch with an opening that is at the 'top' of the opening when the user is wearing the strapvest can be left open for easy access or to allow long objects to protrude; openings along an edge of a strap oriented where items are more likely to fall out, would typically have an operable closure or at least a flap to retain the contents inside the pocket. For example, a hook and loop closure can be provided (e.g., a flap having hooks that mates to a surface on the receptacle having compatible hooks), or a zipper, or a drawstring, or one or more snaps or buttons, or a magnetic closure can be used. Pockets built into the straps can be made of the same material as the strap, e.g., they can be formed by a space between two layers of strap material, or they can be formed by addition of separate material to the strap, so that a strap surface can be part of the pocket; thus a receptacle or pocket may have mesh or transparent plastic forming an external surface, as befits the contents of the receptacle or pocket. Where appropriate, a pocket in or on a vest of the invention can have a clear plastic covering or window, and can be designed to hold an item like an identification card, electronic access card, or business card, so that it can be seen or used without taking the card out of the pocket.

The main straps 2, 4 are optionally curved (80, 82) so that they can conform to the torso of the user without buckling or distorting excessively. This curvature refers to lateral curvature of the strap across its width, as the strap is typically quite flexible in its thickness dimension. The upper strap portions can be curved inwardly (toward each other) as they approach and pass over the wearer's shoulders, as shown in FIG. 1, if the straps are to be crossed in front of the wearer's body (see FIG. 2) or to meet in front of the wearer's body; or they can curve slightly inward up to the wearer's shoulders then fall straight downward in front or curve outward if the straps are not intended to cross in front of the wearer's body when worn (see FIG. 8). In the latter case they may curve outwards after they pass down the upper portion of the torso in order to connect to lower straps that circle around to the front of the wearer. (And as discussed herein, the main straps may also be continuous.) Either the shoulder strap sections or the lower strap sections can be curved, or both sections can be curved, depending upon how the straps are to be positioned, provided a first the shoulder strap (either the right or left one) connects to a first lower strap, and the second shoulder strap connects to the second lower strap. The straps preferably connect at a position where it is easy for the wearer to buckle or otherwise connect the strap portions where they meet; and in some embodiments they are integral, i.e., the upper and lower straps combine to form a continuous, unitary strap that needs no buckle for connection. In such embodiments, the straps often do not cross in front of the wearer's body; rather they are releasably connected in front of the wearer's body instead.

Figure 3:
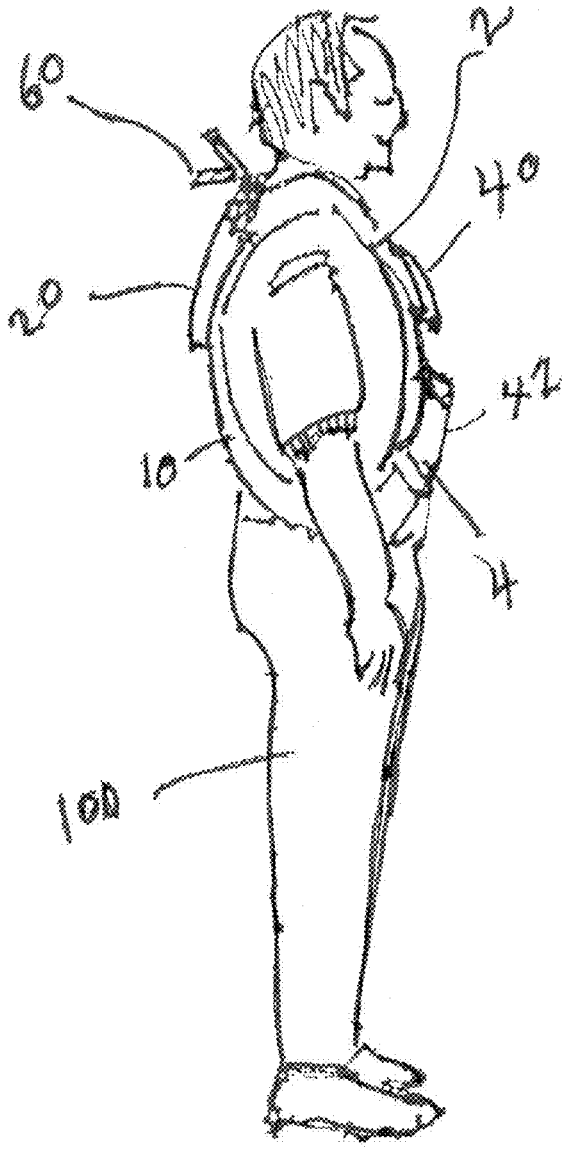
FIG. 3 is a side view of a person wearing an X shaped strapvest of the present invention.
Figure 4:
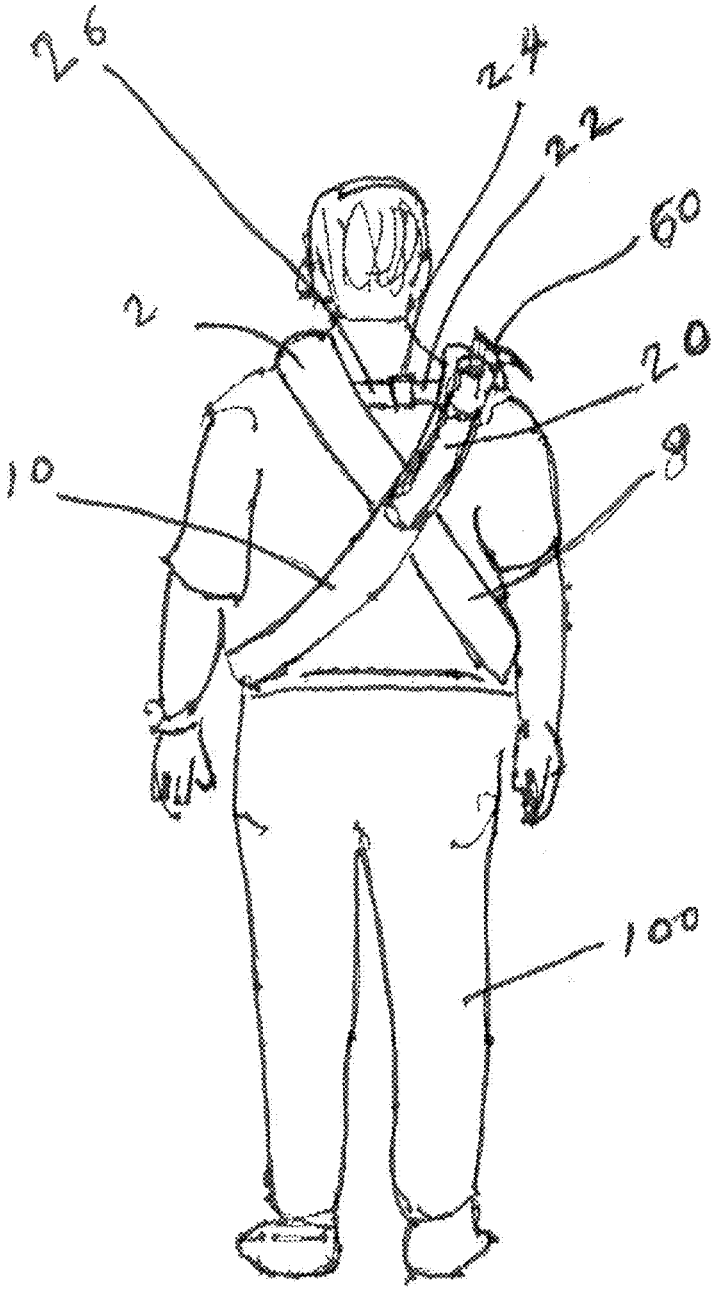
FIG. 4 is a back view of a person wearing an X shaped strapvest of the present invention.

FIG. 2 shows a person (100) wearing an X shaped vest of the invention. Main straps 2 and 4 are crossed ever each other in front of the user, as well as in back. Pockets 36, 38, 40, and 42 are easily accessible to the user. The main straps 2 and 4 wrap snuggly around the user so that neither the vest nor the items contained in the vest will significantly interfere with the user's motions. Pocket 20 in this illustration is designed to hold a caulking gun or similar elongated tool (60) on the user's back. The user can pull the elongated item from its holder 20 the way an archer would pull arrows out of a quiver, by reaching up and over one shoulder. Pocket 20 can also be used to hold a hammer, with its handle or its head conveniently accessible, or a folding saw used by campers, or a flashlight or umbrella used by a hiker, or even a water bottle. Longer items such as these can be difficult to accommodate on a belt, as they interfere with the user's ability to bend forward at the waist or to access pant pockets; and they tend to be heavy enough to drag a belt downward. By contrast, they are easily borne by the straps of the strapvest, which transfer the weight of such item directly to the shoulder of the wearer and thus do not tend to pull or push the wearer's pants down the way a heavy belt can. FIGS. 3 and 4 show a wearer with this embodiment, from side and rear perspectives, and illustrate desirable placements for some pockets or receptacles.

FIG. 4 shows a rear view of a person wearing the strapvest of the present invention. In this view adjustability of cross-strap 26 can be seen, represented by a buckle that permits the length of the strap to be adjusted. The cross-strap is positioned above the juncture where the two main straps overlap or connect on the wearer's back, and the illustration suggests how it can be adjusted to a length suitable for keeping the straps on the wearer's shoulders, as items in the receptacles or pouches tend to pull the straps outward, away from the wearer's neck and onto the shoulders. Additionally, elongated pocket 20 can be seen holding a caulk gun 60, demonstrating how the straps on the back of the user can also provide useful additional carrying capacity for items that would be difficult to accommodate using a belt, for example.

Figure 5:
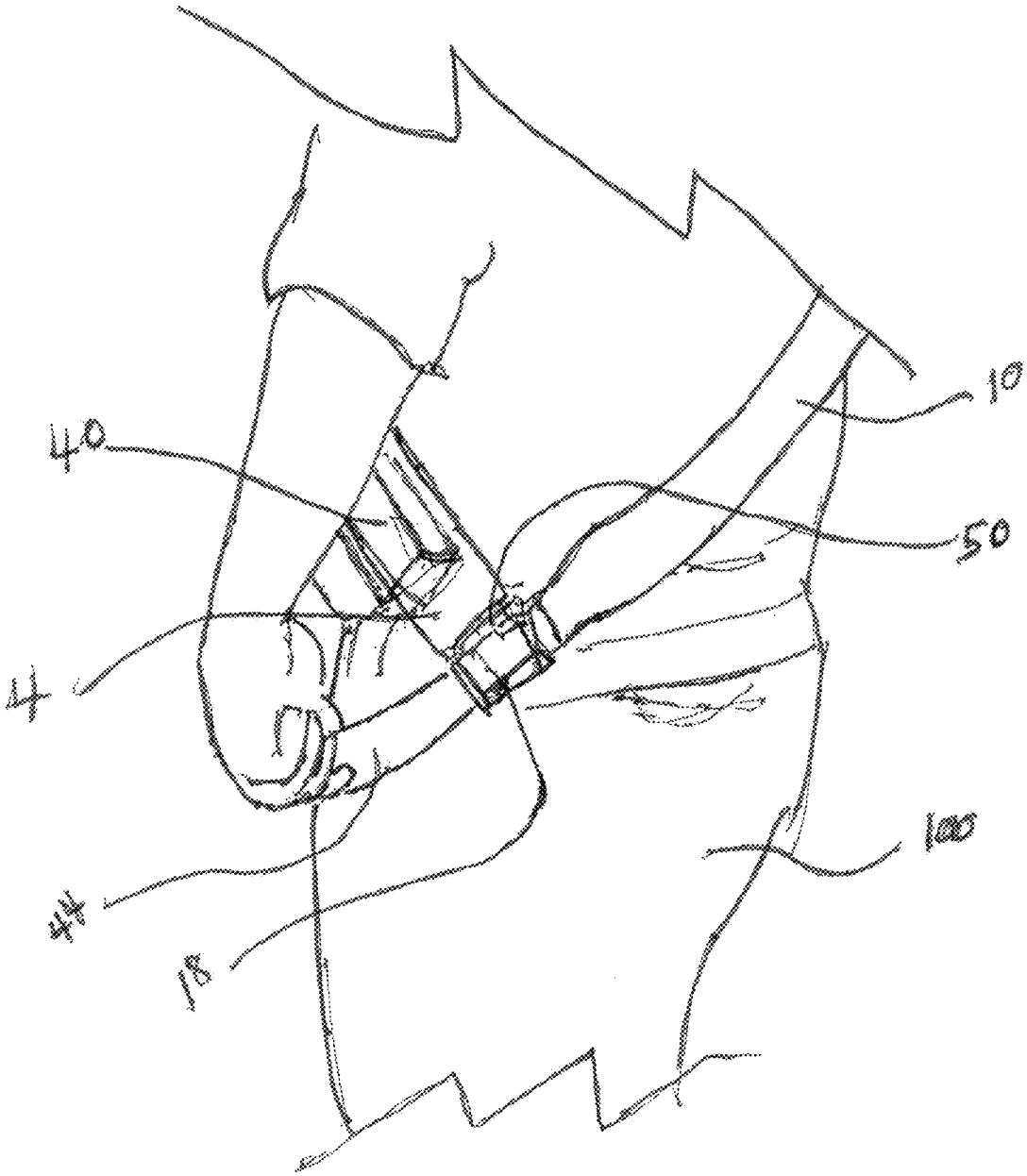
FIG. 5 is a partial side view of a person adjusting the strap of an X shaped strapvest of the present invention.

FIG. 5 shows a partial side view of the user 100 adjusting strap 44. It depicts one position where a buckle can be placed for convenient access to adjust the length of the straps and to unbuckle one of the straps to remove the strapvest. By tightening or loosening straps 44 and 46, the user can make the vest adapt to his or her body size or to accommodate varying outerwear. As this figure shows, the buckle portions can be positioned so that the adjustable part may slide along strap 10 or an extension 44 of strap 10 to permit adjustment. For example, a cam-type buckle can be used to adjust the position on strap extension 44 where strap 4 connects; and the attachment of the sliding part on extension 44 can connect to the buckle portion of the lower strap at an angle. In FIG. 5, the buckle appears to connect the two straps at approximately a right angle; however, the exact angle for this connection will depend upon where the buckle is placed, the length of the straps and the amount of curvature of the main straps. Optionally, the buckle portion of strap 10 or extension 44 can be configured so that the connecting portion that mates to the buckle portion on the shoulder strap it connects to can swivel, to permit the two buckle portions to connect at an adjustable angle, for further flexibility to accommodate adjustments of the size for an individual user.

Figure 6:
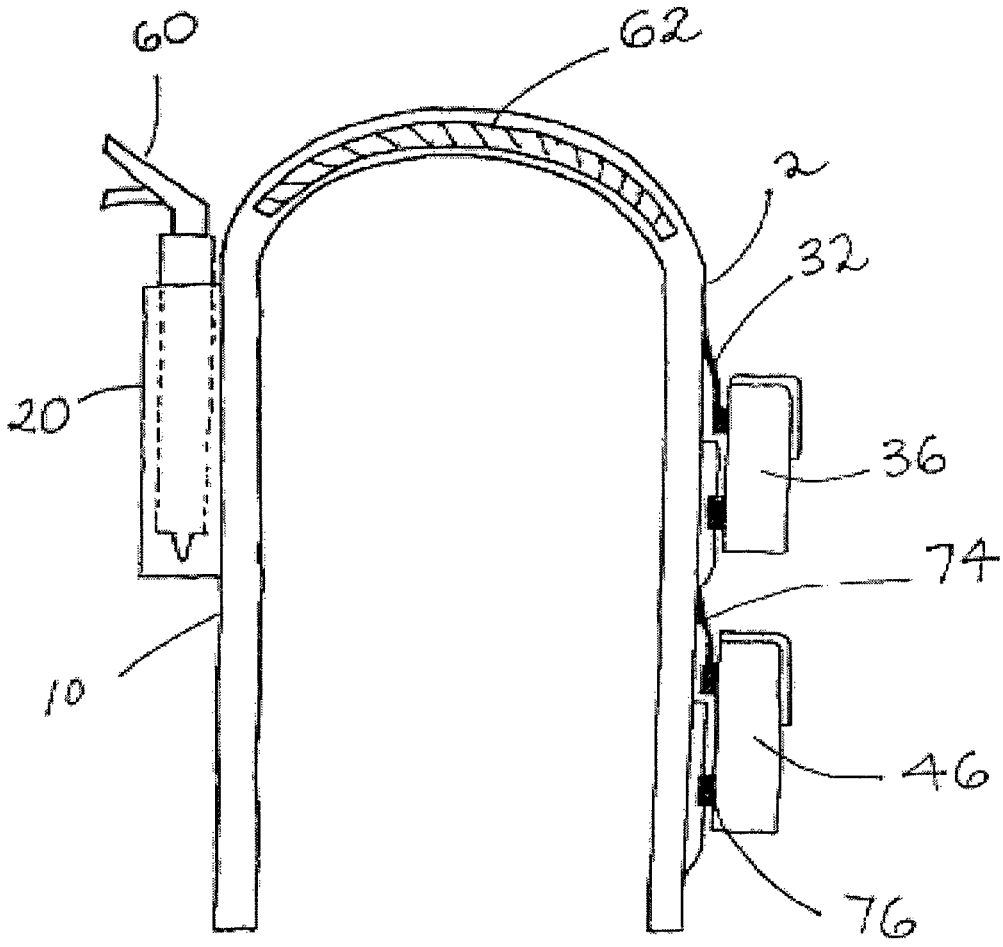
FIG. 6 is a partial side section view of an X shaped strapvest of the present invention.

FIG. 6 shows a partial side section view of one embodiment of the present invention. In this view, one can see that the main strap 2 is supported by substrap (second layer) 35, and the strap and substrap are connected together along one edge to form a concealed flat pocket, which can be accessed by an opening (32) on or near the other edge, which opening can optionally be closable by a zipper. The space between the two creates a place for a person to store flat items as discussed previously, and optionally this space can be lined with a waterproof barrier to keep liquids from damaging items like cash or business cards stored inside. In applications where a waterproof pocket is desired, it may be preferable to use a 'Zip-Lok™' type of toothless plastic zipper or seal to seal the pocket against moisture.

At the upper portion of the strap, where it passes over the wearer's shoulder, a resilient pad 62 can optionally be inserted in the space between the main strap 2 and the sub strap 35, or it can simply be attached to the inner side (underside) of a shoulder strap that does not have a second layer; or the section of this strap running over the shoulder of the wearer can be made of a softer, better padded, or wider material to better distribute weight over and provide padding to the wearer's shoulders. Padded section 62 of the shoulder strap helps evenly distribute the weight of the vest and its contents as well as preventing the straps from digging into the user's shoulders, reducing discomfort associated with wearing a strapvest that may be heavily loaded with tools or supplies, water bottles, etc.

Features 74 and 76 represent hook and loop strips used to attach the receptacle 46 to the strap, on the outer face of a strap preferably positioned in the front of the user. This detachable way of mounting the receptacles helps adapt the strapvest to users of various sizes and for receptacles of various sizes, and of course permits the user to mount a number of different receptacles needed for one project, e.g., one receptacle for each size or type of fastener when the user requires multiple sizes of nails or screws.

Figure 7:
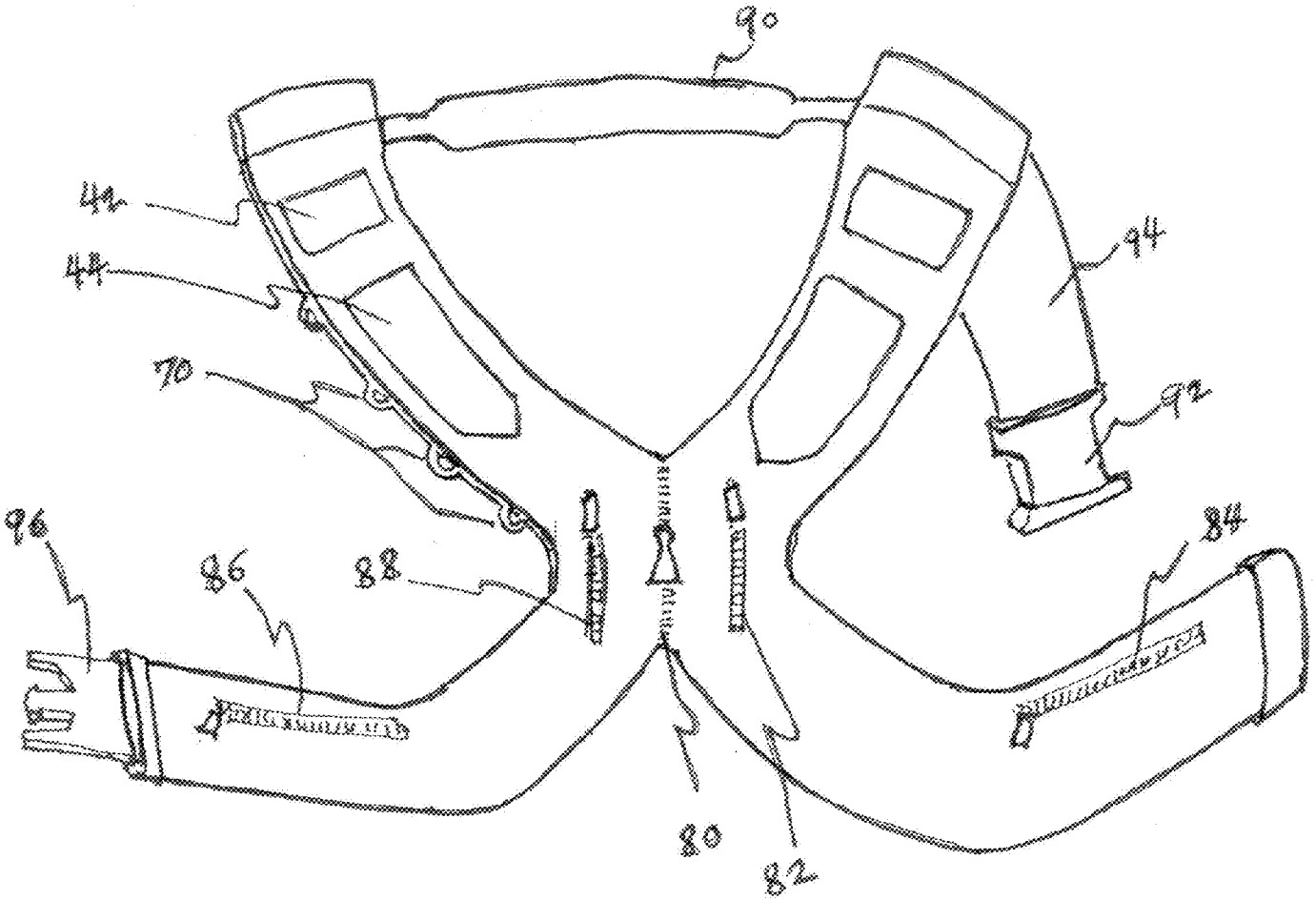
FIG. 7 is an alternate embodiment of the present invention. In this version, the lower straps are contoured to curve outward, away from each other, and to wrap around the wearer's waist or abdomen; and the shoulder straps are shaped to run over the shoulders of a wearer and down. The straps in such embodiments do not cross in front of the user's body, but are typically able to connect together releasably in front of the wearer, and cross or connect at a juncture on the wearer's back.

FIG. 7 is an alternate embodiment of the present invention showing only the front of a strapvest and the cross strap 90 that connects the portions of the main straps in back, which are hidden in this view. It shows where zippered pockets 82, 84, 86, 88 can safely hold additional items, and the main straps can be connected by a zipper (for example) in front of the wearer. Zipper 80 allows the user to put on the vest without disconnecting snap or buckle closures 92 and 96; or it allows the strapvest to be constructed without need for buckles built into and interrupting the main straps. Cross Strap 90 is non-adjustable in this embodiment, and can display a logo such as X-VEST or other name of the product or its manufacturer, or it can be personalized for its owner's preferences. It is positioned on the wearer's back as described throughout when the strapvest is in use. In this embodiment, the straps running downward in the drawing are the lower straps, and are curved outward significantly so they can meet with and connect to the buckle portions on the shoulder straps. In this embodiment, the shoulder straps do not have to cross in front of the wearer; the right shoulder strap can connect (buckle) to the right lower strap, and the buckle portion 91 on the right shoulder strap can be compatible with a buckle portion on the lower right strap (not shown). Similarly, the left shoulder strap can connect to the left lower strap, near the wearer's side. This Figure also depicts a series of loops (70) along an edge of one strap, useful to retain a headphone cord for a cell phone or audio device.

The cross strap as shown (90) can be used to support a receptacle in some embodiments, and can be adjustable; in the embodiment in FIG. 7 it is used as a place for a logo, or it can be used as a place to provide a place for the wearer's name or other identifying information to be displayed, like a favorite sports team's name. The cross strap for any of the embodiments can be made of the same material as the main straps, or it can be a different material. Suitable materials for the cross strap include those described herein as suitable for the main straps.

Figure 8:
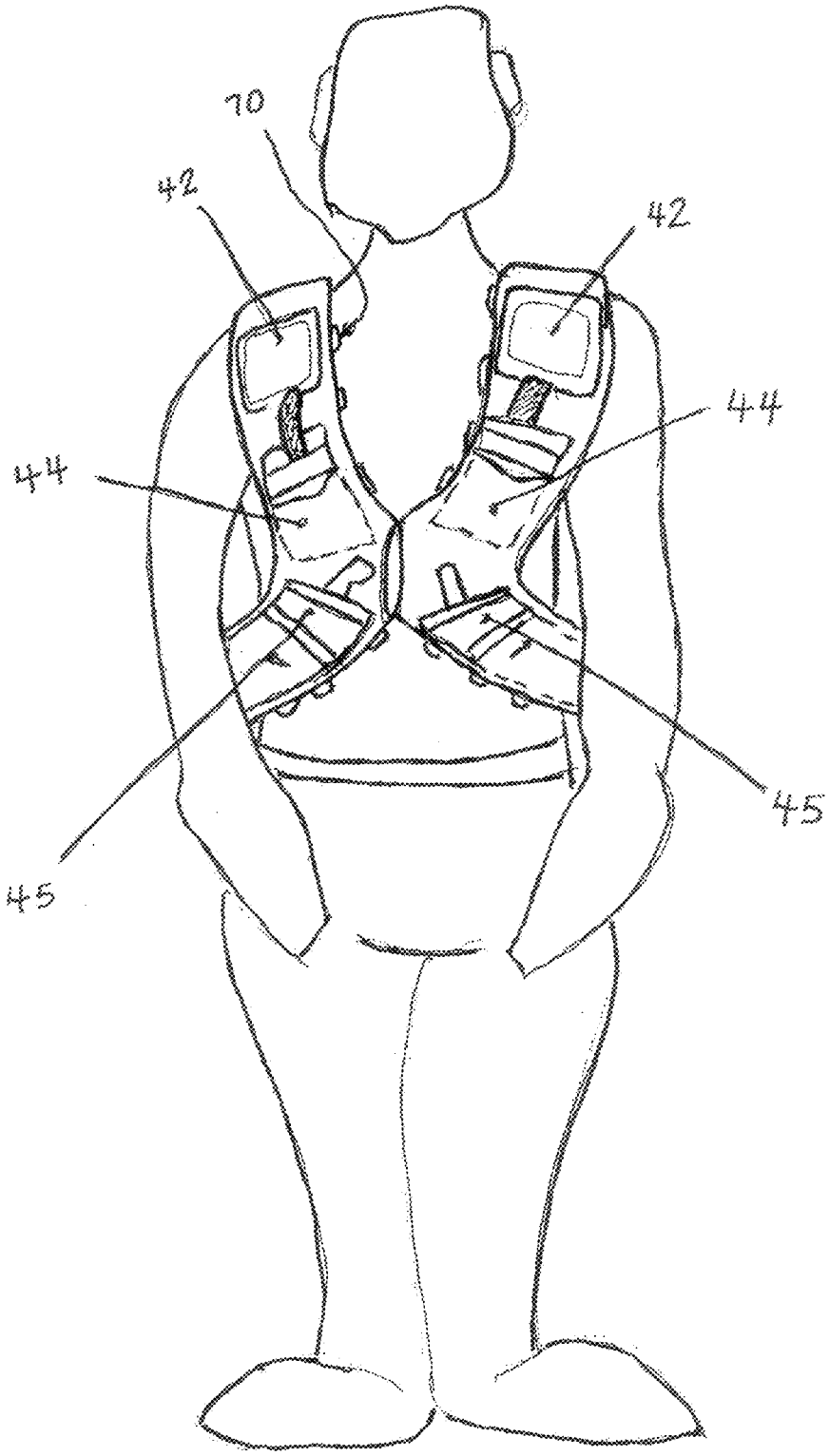
FIG. 8 shows a person wearing a strapvest of the invention, and illustrates the use of specific features such as a pocket with a clear plastic window to display an identification card, and double pockets (one atop another) to provide extra compartmentalized storage for thin items that can fit inside a multi-layer strap. The pockets can be open, or they can have a zipper or flap or similar closure to increase security of objects placed inside.
Figure 9:
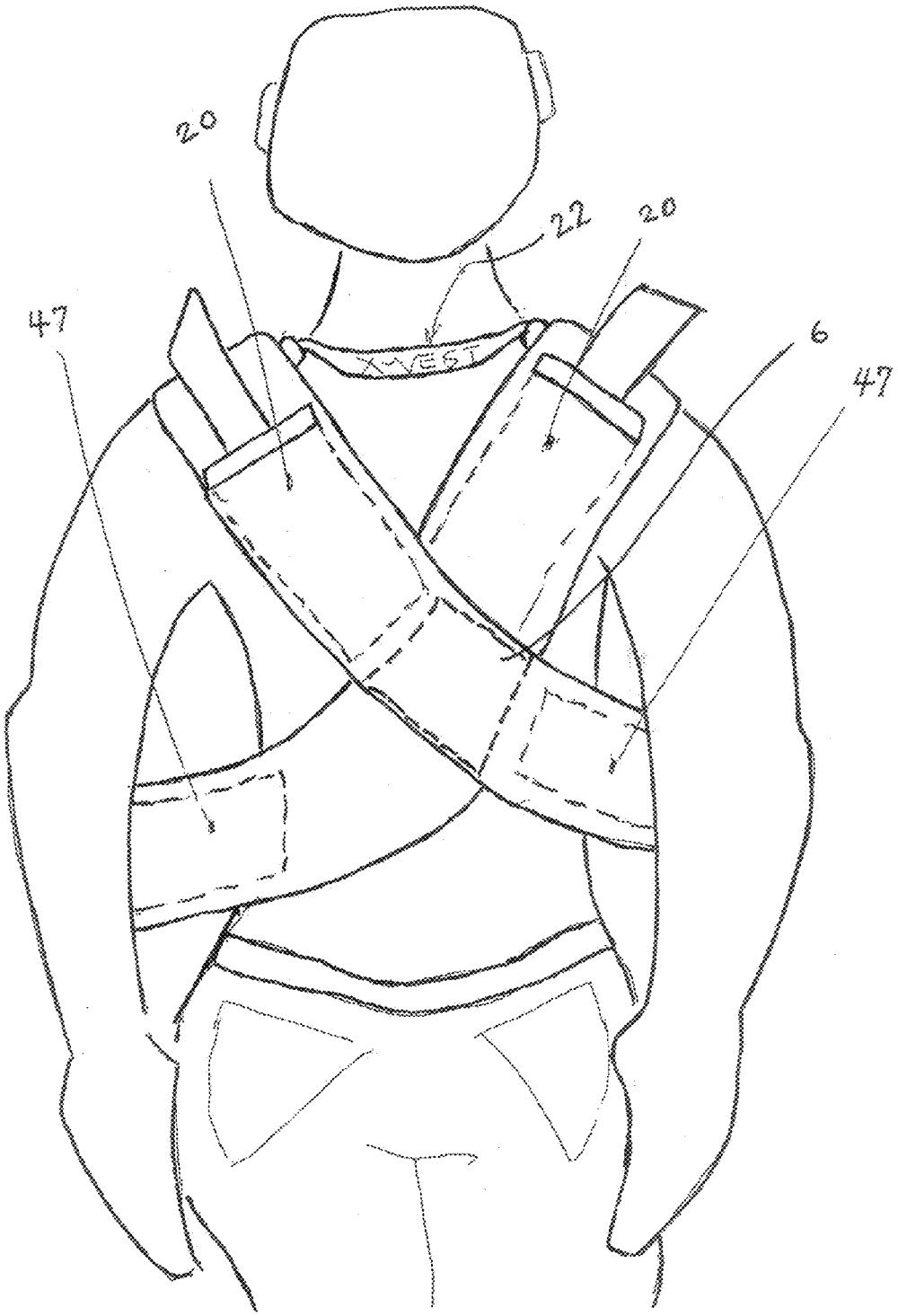
FIG. 9 shows how the cross strap can be positioned on a wearer's back to prevent the strapvest from sliding forward in use, and to prevent the straps from slipping off of the shoulders of a wearer.

FIGS. 8-10 depict another embodiment of the invention, in which the straps may be attached to each other in front by a short zipper or hook-and-loop closure, having several sets of pockets that are easily accessed by the wearer. Optionally, double pockets can be used, where one pocket is formed on top of another (e.g., 44), to provide additional compartmentalized storage for thin, flat items or for papers and the like; for example, one may hold papers and the other a pen or pencil, separated from the papers to avoid marking them unintentionally. Pockets near the shoulders in front (42) may be used to hold a name tag, access badge or the like for ready inspection. The various pockets on strapvests described herein are generally open along the highest side when the strapvest is worn, and items are placed into the pockets from that opening, which is typically at the top of the pocket. The main straps in this embodiment are contoured so that they curve inward as they lead down from the wearer's shoulders until they are near enough together to be connected together, then they curve outward below the connection region to wrap around the wearer's waist or torso and connect to the lower straps. In this embodiment, the straps may not have buckles connecting the upper and lower straps: the straps may be continuous, and connected together in the front as described. In back the straps will still cross over each other as depicted in FIG. 9.

In such embodiments, a front juncture may be positioned in front of the wearer in addition to the juncture in the back, and the main straps can simply cross over each other in the back (see FIG. 9) without necessarily being connected together, provided the cross strap is positioned to help hold the strapvest in position. Still, the straps are typically connected to each other in the back to stabilize them, and the device still typically includes the cross-strap to further stabilize the main straps and keep the device from shifting forward on the wearer's body or sliding off the wearer's shoulder under the load that may be present in the receptacles or pockets of the front portion of the strapvest.

Moreover, in this embodiment, the straps at the wearer's sides do not need to have buckles or other connectors; they can be continuous straps, since the wearer can fasten and unfasten the strapvest by a closure in the front that connects the main straps together. FIG. 10 illustrates how the straps can be configured with a curve or an angle of about 90 degrees placed along the wearer's side to wrap around the body of the wearer from the front to the back, so that the straps can lead back to the juncture on the wearer's back, but other configurations having a curved lower portion at the wearer's side, or even a 'straight across' portion between the main strap sections can be employed to meet the needs of a particular type of user. As illustrated in these Figures, pockets or receptacles that are on portions of the strapvest that are not easily accessible to the user's hands when the strapvest is in use (i.e., portions lying on the wearer's back when the strapvest is being worn) can nevertheless be used to hold items that stick up for easy 'over the shoulder' access, or they may be adapted with a closure and used to hold items that are not needed frequently, such as extra batteries, or first aid materials. Pockets can also be built into or attached to sections along the wearer's sides (45, 47). Note that in some embodiments, the pockets or receptacles on the potions of the strapvest positioned on the wearer's back when in use may be built into the straps, or secured to the straps by snaps or zippers, i.e., not by hook-and-loop fastening material, because these pockets or receptacles may otherwise be prone to being dislodged if the wearer sits down, for example.

In still other embodiments, the strapvest can be designed much like the one depicted in FIG. 8, but having a single-point closure to connect the main straps in front of the user, rather than a zipper section or other elongated closure. This closure can be a button or snap, or it can be a stud-type closure (e.g., a standing stud that has a pivoting portion like that of a cufflink on one main strap, designed to fit through a hole in the other main strap). This single-point closure offers several useful advantages: it enables the device to be varied in 'size' to accommodate diverse users, and it allows the lower portions of the strapvest to pivot out of the way when the user sits down or bends forward, so the strapvest does not unduly restrict the wearer's movements. The closure can comprise a snap, button or hole on a first strap, and multiple copies of the snap, button or hole can be present at different positions on the first strap, to mate with a complementary part on the second strap to provide some adjustability. For example, a main strap 3-5 inches wide could have 2, 3 or 4 different holes for a button or stud-type fastener to connect to; the holes can be positioned at different positions laterally across the strap, so the user can size the vest by selecting a hole that works best. And as discussed herein, the use of a single-point closure for this connection permits the lower portions of the strapvest to swing outward when the wearer sits down, or to pull inward as the wearer stretches upwards. The result of the single-point closure permits the wearer to enjoy increased freedom from restrictions of movement that result from using an elongated connection between the main straps.

In some embodiments, the strapvest performs as a combination tool belt and wallet for a user who needs to carry many items. Because valuables may be put into the straps, and it may at times need to be temporarily removed and put down by a wearer in a nonsecure location, a modest amount of security for the vest and/or its contents can be provided by a cable-type locking mechanism similar to ones used for a notebook computer, e.g, one requiring a conveniently small key or a combination to open the lock. Such a cable-lock can be used to secure the strapvest temporarily to a banister, large piece of furniture, or other item that is difficult to move or break. Additional security for items in the flat pockets inside the bilayer straps can be provided by concealing the zipper from casual view, for example by placing the opening or zipper on the side of the strap facing the wearer's body, and possibly concealing it under a flap of strap material.

Figure 11:
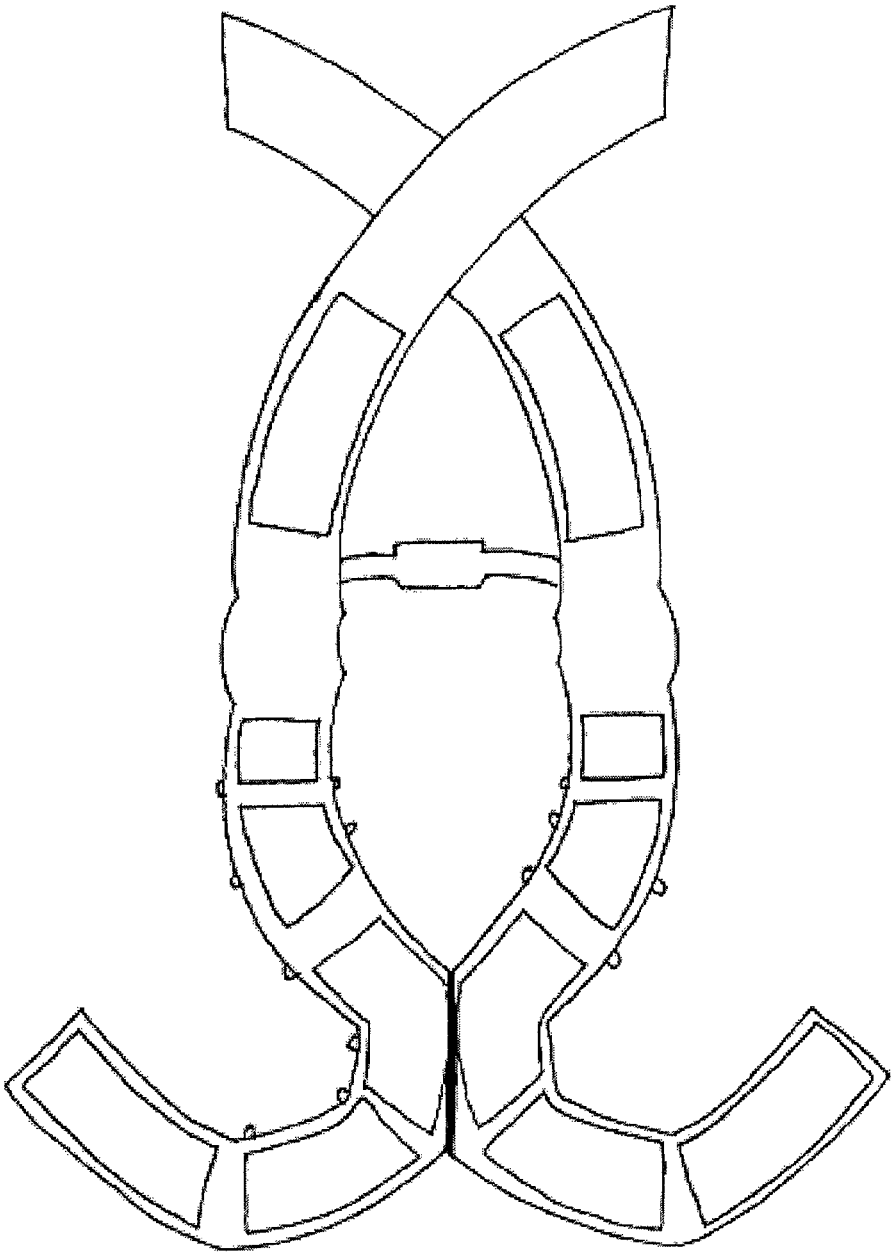
FIG. 11 shows a view of one embodiment of the invention, including dimensions for some features of the main straps and of size and placement of material positioned to hold detachable receptacles or pockets on the straps.
Figure 12:
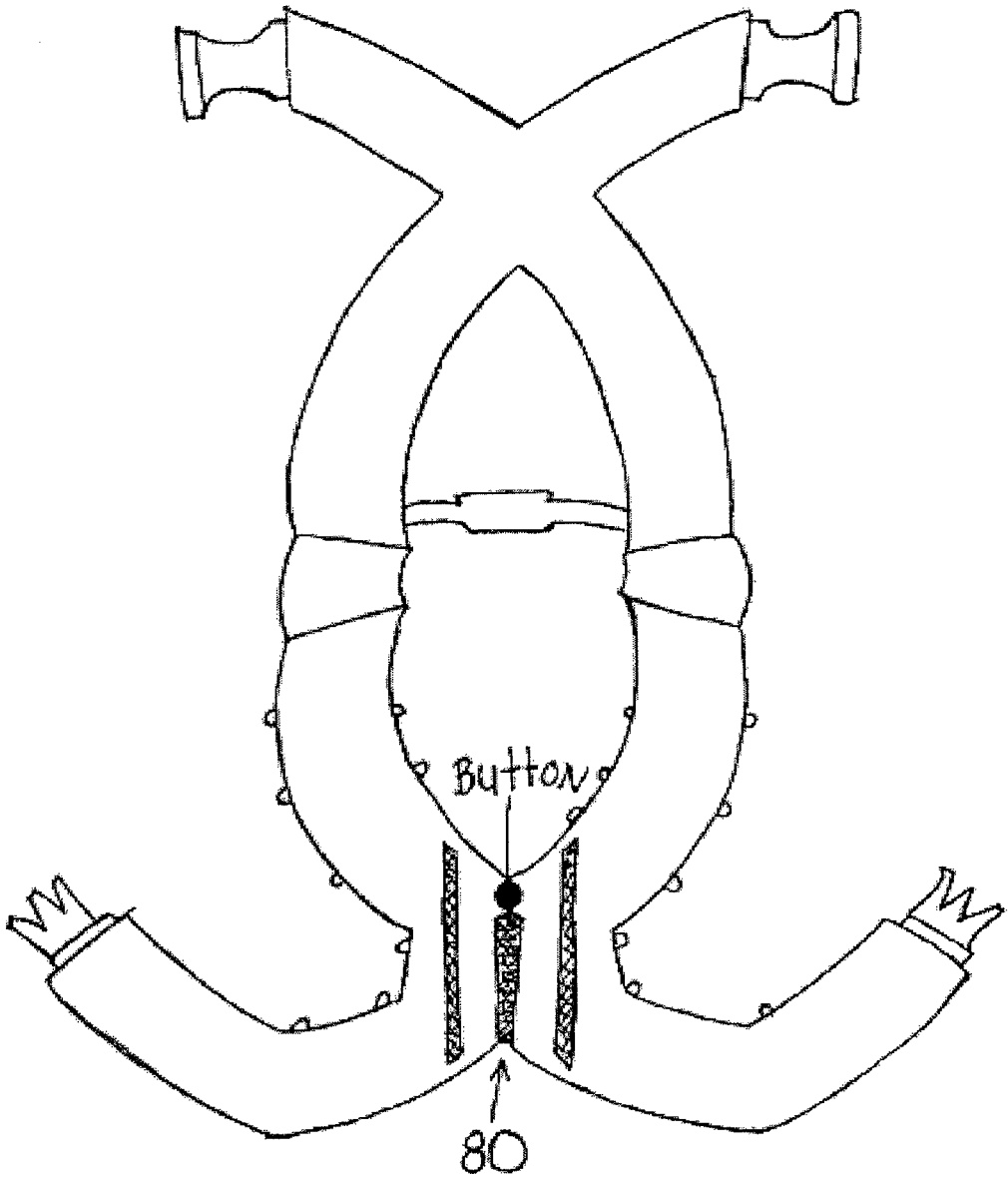
FIG. 12 shows placement of zippered pockets facing the inside of this embodiment, i.e. hidden pockets on the side of the straps facing the wearer's body.

FIGS. 11-13 depict another embodiment of the straps of a strapvest having a front closure, and depicting some of the relevant dimensions of an embodiment of the device. It illustrates an embodiment having hook-and-loop patches positioned to hold receptacles along the straps. While the particular embodiment appears to have main straps that could be connected by buckles, the same basic design can be used with continuous main straps, in which case the juncture in front of the wearer's body would typically include a releasable connection between the main straps. The straps in this embodiment are about 3.75 inches wide, and have hook-and-loop patches of various sizes spaced along the straps in the front of the wearer's body, and a longer patch on each of the straps on the wearer's back. The front closure can be a zipper or Velcro™ (hook and loop closure material), or it can be a button or snap, or it can be a combination of these. FIG. 11 also shows how a patch of hook and loop material can be attached to a portion of a strap to provide a place to hold items or to attach the receptacles described herein. In some embodiments, a band of such hook and loop material is attached to a main strap, and provides attachment for a receptable having mating hook and loop material on its perimeter. (49)

FIG. 12 depicts the inner surface of a strapvest such as the one in FIG. 11, to show that zippered compartments can be placed to open on the inside for security; such compartments would typically be near the releasable closure (represented here by a button and a zipper) that connects the two main straps in front of the wearer so that the hidden compartments could be accessed while the strapvest is being worn.

FIG. 13 depicts one type of receptacle, a plastic case or box (51), which can be attached to a base on a strap of the various embodiments of the strapvest. The base can include rails or tracks (53) onto which the plastic case can slide, and a button or two (52) to release the case from those tracks can be incorporated into the case. The figure in this case shows only the front portions of such a strapvest. Such detachable receptacles can be used on any convenient portion of any of the designs discussed herein, such as the front of the vest as illustrated by 56, which represents a plastic case adhered to a main strap of the vest, and it illustrates a band of hook and loop material on a main strap (57) provided to secure such a receptacle to the vest by a mating band of hook and loop material on the perimeter of the back of the plastic case. FIG. 13 also depicts a pocket (54) built into the strap underneath the position that is configured to attach a receptacle, in this case a band of hook and loop material sewn to the outer surface of the strap outside the pocket 54.

In the above illustrated and described ways, a person can make and wear an X shaped vest of the present invention to carry various items in close proximity to their body so that the user may have easy access to the items contained in the pockets and/or receptacles of the vest. The vest is light weight and provides maximum ventilation to the user, allowing the user to select suitable outerwear or protective wear with minimal interference. The strapvest can include removable and replaceable receptacles so that the vest can be customized to meet the user's needs, even when they change. The length of the straps of the vest can be adjustable so that one size vest can fit a wide variety of body sizes, or to accommodate different outerwear choices. Pockets formed inside the straps provide places to store or conceal additional items. And the vest can be designed to be removed either by disconnecting buckles in the main straps, or by opening a closure that connects the main straps to each other, typically in front of the wearer's body.

Other special features can be provided on a strapvest for specific types of users. For example, a string-cutting tool can be built into a readily-accessible portion of the strapvest for use by fishermen, or construction workers, or electricians, with a protected blade that can be positioned to permit the user to cut a string with only one hand. Such cutters are known in the art, and typically have a sharp blade that is almost fully enclosed, but is accessible by a slot that is too narrow for a user's fingers or body parts to fit into, providing safety even in the presence of a very sharp cutting implement that is useful for cutting strings and the like. Protected cutting implements suitable for this are known, and by attaching such implement to the strapvest, the wearer is enabled to work more efficiently by avoiding the need to have two hands free each time a string or wire needs to be cut. The string-cutting tool can be built into a strapvest strap or surface, or it can be tethered to the strapvest near a convenient receptacle. It is advantageous to have the string-cutting tool secured to the strapvest near the center of the wearer's body for easy use for cutting strings or wires.

Similarly, the strapvest can include a pocket specially adapted to hold the body of a retractable measuring tape (commonly called a "tape measure") in such a way that a user can pull the measuring tape out with one hand, without needing to hold the body of the device at all, as the body remains held in place by the pocket or receptacle. This is achieved by providing a pocket sized to hold a tape measure device and having a secure closure such as a snap or zipper, where the pocket also provides an opening through which the end of the flexible measuring tape can be reached, and through which the flexible tape can extend when in use. The closure should be secure enough to hold the device in place while the measuring tape is pulled out for use, and the measuring tape device is typically 'spring loaded' so that it will retract the flexible tape when the user releases it. The pocket adapted for this purpose can be near the user's side or waist, or near the front of the strapvest, so that the tape is easily accessible to the user's hands; or this pocket can be on the user's shoulder or even on the back, so that the user reaches up for the measuring tape and pulls it out near eye level where it is easy to read, all depending upon the user's particular applications and needs. Again, this permits a user to perform operations with one hand that would otherwise take two; thus a worker can, for example, measure an item or distance with one hand and record the measurements with the other, and the strapvest can hold both the measuring tape and a writing implement, so it provides easy access to the tools needed for both making the measurements and recording them.

Similarly, the strapvest can comprise a receptacle or pocket specially adapted for dispensing adhesive tape, such as electrical tape, with an integral cutting device to enable a user to pull and cut tape with one hand. Configurations akin to the arrangement of a dispenser for transparent tape can readily be adapted for attachment to or incorporation into the strapvest or a receptacle or pocket of the strapvest.

In some embodiments, the strapvest incorporates a mesh pocket sized to hold a water bottle for carrying a beverage. A convenient placement for this item is along the wearer's side, for example it might be attached to the surface of the strap between pockets 3 and 4 on a device like the one shown in FIG. 10. Optionally, the strapvest can incorporate a bladder-type water carrier in a portion on the wearer's back, such as the juncture, and can have a drinking tube that extends from the bladder-type water container along a main strap, over the shoulder, to a position where it is conveniently accessible for the wearer to drink from the container while wearing the strapvest. Alternatively, the strapvest may be adapted to permit a wearer to attach a bladder-type water carrier to the wearer's back when desired, e.g., it may be removably connected to the juncture or the cross strap or both, so that the container and its drinking tube are still removable, so the water carrier becomes an optional specialized receptacle for the strapvest user to have or not, depending on the needs of the day. Water carriers of this type are known in the art, and include a flexible water-tight container that is adapted for easy filling such as by a round opening approximately 0.5-1.5 inches in diameter having a screw-type lid for secure closure; and a drinking tube that reaches from a lower portion of the container up and over the wearer's shoulder to a position near the wearer's mouth.

In some embodiments, the strapvest further comprises attachment points with which items can be tethered to the vest for security. A user may carry in the vest items that are fragile if dropped, such as handheld electronic devices, or tools that are dangerous when dropped, like cutting implements; and a user may wear the vest for tasks such as working on a ladder or roof where retrieving a dropped item is highly inefficient. For such applications, the strapvest can comprise attachment points for connecting one or more tethers that can be used to attach items to the wearer's person and prevent dropping such items. For example, holes can be provided along an edge of one or more of the straps, preferably near a pocket or receptacle used to hold items that require additional security. Alternatively, loops of suitable material can be provided near the receptacles or pockets holding such items. Thus dangerous or fragile items can be tethered so that they don't fall far when dropped, so that, for example, a knife would be less likely to harm the user when dropped because it would not fall far enough to gather momentum to become dangerous. And items that are secured are less likely to cause the user to grab at them when they are dropped; such sudden movements place the user at risk of falling from a precarious position, such as a ladder or roof.

The features of the strapvest can be selected for the needs of a particular user, and can elevate the strapvest to function as an additional tool that increases safety and efficiency for the user.

In some embodiments, the strapvest can comprise additional features to help stabilize the vest on the wearer's body. For example, it can include hanging straps or elastic straps with clips like those found on suspenders, to connect the strapvest to a wearer's trousers. For example, while not shown, in some embodiments the strapvest further comprises connecting straps on the lower portion of a strapvest such as the one depicted in FIG. 10, where each side of the strapvest could be secured to the trousers or a belt of a wearer, including connecting it to a utility belt that the user might wear with the strapvest. This better holds the strapvest in place without unduly restricting the wearer's movements and can enable the strapvest to function as suspenders for the trousers or utility belt, distributing some of their weight onto the shoulder straps of the strapvest. Particularly where the strapvest is used with items that tend to pull it away from the user's body, such as for carrying heavy items, or when using it to hold a retractable measuring tape, the additional anchoring effect of such connecting straps helps make the strapvest more secure and more effective while also reducing the tendency of the wearer's trousers or utility belt to slip down. In some such embodiments, the strapvest comprises two or more clips that can be detachably connected to a wearer's trousers or belt or utility belt; optionally it would include four such clips, two in front of the wearer's body and two in the back. The clips can be of any design for attaching conveniently and reversibly to a belt or garment, such as those used on suspenders that easily connect to a wearer's pants. In some embodiments, the clips are attached to a strap at a lower edge of the strapvest, or they can be attached to the inner (hidden) side of the strapvest. This permits the 'suspender' straps and clips to be at least partially concealed from view, and permits the strapvest to hang below the point where the suspender straps are connected to the wearer's other articles of clothing (belt, utility belt, or trousers, for example). In some embodiments, at least some of the suspender straps are elastic and able to elongate (like typical suspenders); it is particularly useful for the suspender straps attaching the strapvest to the wearer's other articles of clothing in back of the wearer to be stretchable, in order for those straps to elongate when the wearer sits down or bends forward. It is less important for the suspender straps in front of the wearer to be elastic or stretchable; and in some embodiments the strapvest may not have such suspender straps in the front (only in the back), or the suspender straps in the front may be of non-elastic material. For convenient design, some or most of the length of the suspender straps may be concealed within the interior of the main straps of the strapvest to provide sufficient lengths of elastic material to accommodate the wearer's full range of motions, particularly when sitting down, kneeling, or bending over, where the suspender straps in the back may need to stretch significantly.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined b the appended claims.

What is claimed is:

1. A wearable strapvest, comprising:

a juncture, configured to be position on a user's back, having an upper right edge, a lower right edge, an upper left edge and a lower left edge;

a right shoulder strap extending upwards from the upper right edge, having a first buckle portion near its distal end;

a left shoulder strap extending upwards from the upper left edge, having a second buckle portion near its distal end;

a right lower strap extending downwards from the lower right edge, having a third buckle portion compatible with either the first or second buckle portion near its distal end; and a left lower strap extending downwards from the lower left edge, having a fourth buckle portion compatible with either the first or second buckle portion near its distal end;

wherein the right shoulder strap is configured to run upward over a shoulder of the user then downward over a torso of the user to permit the first buckle portion to connect with the third or the fourth buckle portion, and the left shoulder strap is configured to run upward over another shoulder of the user then downward over the torso of the user to permit the second buckle portion to connect with the third or fourth buckle portion, wherein the right and left lower straps are contoured to allow the straps to conform to a body of the user when worn with the shoulder and lower straps buckled together;

and wherein the right and left shoulder straps are adapted to permit receptacles to be detachably attached to portions of a surface of the straps facing outward from the body of the user on segments of the shoulder straps that are on a side and/or a front of the user when the strapvest is worn.

2. The strapvest of claim 1, wherein at least one of the left and right lower straps comprises two layers of material joined along lower edges of the at least one of the left and right lower straps and a zipper near upper edges of the at least one of the left and right lower straps to provide access to a pocket formed between the two layers of the at least one of the left and right lower straps.

3. The strapvest of claim 1, wherein at least one elongated receptacle comprises an opening at a top of the receptacle that is sufficiently rigid to remain open when not subject to pressure and is positioned on one of the shoulder straps at a point on the user's back to receive an elongated object that can be placed in the receptacle by the user reaching over his shoulder.

4. A strapvest comprising:

a pair of main straps that are attached together to form an X shape across a wearer's back;

each said strap adapted to hold a plurality of removably attachable receptacles on a strap surface away from a body of the wearer;

wherein each of the straps runs upward from a junction so that one strap passes over a right shoulder of the wearer and another strap passes over a left shoulder of the wearer, then each strap runs down a torso of the wearer in front of a body of the wearer and curves around the wearer's torso at a level below a position of the junction on the wearer's back, and then runs up to the junction to complete the X-shape of the strapvest;

further comprising a cross strap that connects the two main straps together at a point on the wearer's back above the junction, wherein each side strap has a first layer and a second layer of material along at least a portion of its length, said first layer and second layer of each strap connected along at least one edge to form a compartment between the first and second layers of each strap, and wherein the first and second layers of each strap are connected together across a width of the straps to form a first end and a second end of the compartment, and a zippered opening along a length of the strap between the first end and second end of the compartment provides access to an interior of the compartment.

5. The strapvest of claim 4, wherein each of the straps includes a buckle that can be disconnected, wherein each buckle is positioned to be accessible to the wearer when the vest is being worn so the wearer can disconnect one or both buckles to remove the vest.

6. The strapvest of claim 4, having one or more cord holders on one of said straps positioned near the shoulder of a wearer, said cord holders adapted to retain a wire for a headphone.

7. The strapvest of claim 4, wherein the cross strap is adjustable in length.

8. The strapvest of claim 4, wherein each said main strap has an inwardly facing curve at its lower end to aid in the tailored fit of said vest straps with regard to a person's torso.

9. The strapvest of claim 4, wherein two or more portions of the straps that are in front of the wearer's body are connected to each other in front of the wearer's body.

10. The strapvest of claim 9, wherein the two or more portions of the straps that are connected to each other in front of the wearer's body are connected by a zipper.

11. The strapvest of claim 9, wherein the two or more portions of the straps that are connected to each other in front of the wearer's body are connected by a single point closure such as a button or snap.

12. The strapvest of claim 4, wherein at least one pocket or removably attachable receptacle is positioned on a strap portion on the wearer's back.

13. The strapvest of claim 4, which further comprises a plurality of receptacles adapted to detachably connect to the pair of main straps of the strapvest.

* * * * *